US007757552B2

(12) United States Patent
Bogath et al.

(10) Patent No.: US 7,757,552 B2
(45) Date of Patent: Jul. 20, 2010

(54) DOWNHOLE TOOL SENSOR SYSTEM AND METHOD

(75) Inventors: Christopher C. Bogath, Cheltenham (GB); Kimi M. Ceridon, Houston, TX (US); Kate I. Gabler, Sugar Land, TX (US); Minh Trang Chau, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 100 days.

(21) Appl. No.: 11/970,823

(22) Filed: Jan. 8, 2008

(65) Prior Publication Data

US 2009/0013775 A1 Jan. 15, 2009

Related U.S. Application Data

(62) Division of application No. 10/904,021, filed on Oct. 19, 2004.

(60) Provisional application No. 60/523,653, filed on Nov. 20, 2003.

(51) Int. Cl.
*E21B 47/00* (2006.01)

(52) U.S. Cl. ..... 73/152.49

(58) Field of Classification Search ..... 73/552.43, 73/152.48, 152.49, 152.59
See application file for complete search history.

(56) References Cited

U.S. PATENT DOCUMENTS

| | | | | |
|---|---|---|---|---|
| 2,667,626 A | | 1/1954 | Blancher | 340/854.5 |
| 2,957,159 A | | 10/1960 | Fitchette | 340/854.6 |
| 3,827,294 A | | 8/1974 | Anderson | 73/152.48 |
| 3,968,473 A | | 7/1976 | Patton et al. | 367/83 |
| 4,120,198 A | | 10/1978 | Tanguy et al. | 73/152.48 |
| 4,245,709 A | * | 1/1981 | Manuel | 175/325.5 |
| 4,265,110 A | | 5/1981 | Moulin | 73/152.59 |
| 4,359,898 A | | 11/1982 | Tanguy et al. | |
| 4,515,011 A | | 5/1985 | Beimgraben | 73/152.48 |
| 4,739,841 A | | 4/1988 | Das | |
| 4,811,597 A | | 3/1989 | Hebel | 73/152.48 |
| 5,099,700 A | | 3/1992 | Morin et al. | 73/862.045 |
| 5,275,040 A | | 1/1994 | Codazzi | 73/152.22 |

(Continued)

FOREIGN PATENT DOCUMENTS

| | | |
|---|---|---|
| RU | 2040777 | 7/1995 |
| WO | WO 01/18357 | 3/2001 |
| WO | WO 03/021115 | 3/2003 |

OTHER PUBLICATIONS

Johnson, Curtis D., "Process Control Instrumentation Technology," Prentice Hall Publisher, XP002365129 (1997).

*Primary Examiner*—Hezron Williams
*Assistant Examiner*—Tamiko D Bellamy
(74) *Attorney, Agent, or Firm*—David J. Smith; Dave R. Hofman

(57) ABSTRACT

An apparatus and method for determining forces on a downhole drilling tool is provided. The downhole tool is provided with a drill collar operatively connectable to the drilling tool, and a sensor mounted about the drill collar. The sensor is adapted to measure deformation of the drill collar whereby forces on the drilling tool are determined. The sensor may be part of a force measurement system, a strain gauge system or a drilling jar system. The drill collar is adapted to magnify and/or isolate the deformation applied to the drill string.

23 Claims, 17 Drawing Sheets

U.S. PATENT DOCUMENTS

| | | | | |
|---|---|---|---|---|
| 5,377,161 | A | 12/1994 | Meehan | 367/82 |
| 5,386,724 | A | 2/1995 | Das et al. | 73/152.59 |
| 5,613,561 | A | 3/1997 | Moriarty | 166/387 |
| 5,850,044 | A | 12/1998 | Spletzer | 73/862.041 |
| 5,900,545 | A | 5/1999 | Sacks et al. | 73/152.52 |
| 6,057,784 | A | 5/2000 | Schaaf et al. | 340/854.4 |
| 6,068,394 | A | 5/2000 | Dublin, Jr. | 702/43 |
| 6,216,533 | B1 | 4/2001 | Woloson et al. | 73/152.47 |
| 6,227,044 | B1 | 5/2001 | Jarvis | 73/152.47 |
| 6,247,372 | B1 | 6/2001 | Spletzer | 73/862.044 |
| 6,343,649 | B1 | 2/2002 | Beck et al. | 166/250.01 |
| 6,547,016 | B2 | 4/2003 | Wassell | 175/45 |
| 6,575,025 | B1 | 6/2003 | Demia | 73/152.52 |
| 6,601,461 | B2 | 8/2003 | Maxit et al. | 73/861.79 |
| 6,633,816 | B2 | 10/2003 | Shirasaka et al. | 702/6 |
| 6,684,949 | B1 | 2/2004 | Gabler et al. | 166/250.01 |
| 6,799,469 | B2 | 10/2004 | Demia et al. | 73/766 |
| 2001/0013410 | A1 | 8/2001 | Beck et al. | 166/65.1 |
| 2001/0013411 | A1 | 8/2001 | Beck et al. | 166/65.1 |
| 2001/0042617 | A1 | 11/2001 | Beck et al. | 166/65.1 |
| 2001/0043146 | A1 | 11/2001 | Beck et al. | 340/855.8 |
| 2002/0070050 | A1* | 6/2002 | Wassell | 175/39 |
| 2003/0010135 | A1 | 1/2003 | Maxit et al. | 73/861.79 |
| 2003/0137430 | A1 | 7/2003 | Chalitsios et al. | 340/870.01 |

* cited by examiner

DOWNHOLE TOOL SENSOR SYSTEM AND METHOD

CROSS REFERENCE TO RELATED APPLICATIONS

This application is a divisional of Ser. No. 10/904,021 filed Oct. 19, 2004 which claims priority pursuant to 35 U.S.C. §119 of U.S. Provisional Application Ser. No. 60/523,653 filed on Nov. 20, 2003, entitled "Downhole Tool Sensor System and Method." This provisional application is hereby incorporated by reference in its entirety.

BACKGROUND OF INVENTION

The present invention relates to downhole drilling of subterranean formation. More particularly, this invention relates to the determination of downhole forces on a drilling tool during a drilling operation.

FIG. 1 shows a drilling rig 101 used to drill a borehole 102 into an earth formation 103. Extending downward from the rig 101 is a drill string 104 with a drill bit 105 positioned at the bottom of the drill string 104. The drill string also has a measurement-while-drilling ("MWD") tool 106 and a drill collar 107 disposed above the drill bit 105.

The drill bit and associated sensors and equipment that are located near the bottom of the borehole while drilling form the Bottom Hole Assembly ("BHA"). FIG. 2 shows a BHA 200 positioned at the bottom of a borehole 102. The drill bit 105 is disposed at the end of the drill string 104. An MWD tool 106 is disposed proximate to the drill bit 105 on the drill string 104, with a drill collar 107 positioned proximate to the MWD tool 106. FIG. 2 shows sensors 202 disposed about the drilling tool for taking various downhole measurements.

The drilling of oil and gas wells involves the careful manipulation of the drilling tool to drill along the desired path. By determining and analyzing the forces acting on the drilling tool, decisions may be made to facilitate and/or improve the drilling process. These forces also allow a drill operator to optimize drilling conditions so a borehole can be drilled in a more economical way. The determination of the forces on the drill bit is important because it allows an operator to, for example, detect the onset of drilling problems and correct undesirable situations before a failure of any part of the system, such as the drill bit or drill string. Some of the problems that can be detected by measuring these downhole forces include, for example, motor stall, stuck pipe, and BHA tendency. In cases where a stuck pipe occurs, it may be necessary to lower a 'fishing' tool into the wellbore to remove the stuck pipe. Techniques involving tools, such as drilling jars, have been developed to loosen a BHA stuck in the borehole. An example of such a drilling jar is described in U.S. Pat. No. 5,033,557 assigned to the assignee of the present invention.

The forces acting on the drilling tool that can affect the drilling operation and its resulting position may include, for example, weight-on-bit ("WOB") and torque-on-bit ("TOB"). The WOB describes the downward force that the drill bit imparts on the bottom of the borehole. The TOB describes the torque applied to the drill bit that causes it to rotate in the borehole. A significant issue during drilling is Bend, the bending of the drill string or bending forces applied to the drill string and/or drill collar(s). Bend can result from WOB, TOB, or other downhole forces.

Techniques have been developed for measuring the WOB and the TOB at the surface. One such technique uses strain gauges to measure forces on the drill string near the drill bit.

A strain gauge is a small resistive device that is attached to a material whose deformation is to be measured. The strain gauge is attached in such a way that it deforms along with the material to which it is attached. The electrical resistance of the strain gauge changes as it is deformed. By applying an electrical current to the strain gauge and measuring the differential voltage across it, the resistance, and thus the deformation, of the strain gauge can be measured.

An example of a technique using strain gauges is described in U.S. Pat. No. 5,386,724 issued to Das et al ("the Das patent"), assigned to the assignee of the present invention. The Das patent discloses a load cell constructed from a stepped cylinder. Strain gauges are located on the load cell, and the load cell is located in a radial pocket in the drill string. As the drill string deforms due to downhole forces, the load cell is also deformed. The strain gauges on the load cell measure the deformation of the load cell, which is related to the deformation of the drill collar. As described in the DAS patent, the load cell may be inserted into the drill collar so that the load cell deforms with the drill collar.

FIGS. 3A and 3B show the load cell 300 disclosed in the Das patent. The load cell 300, as shown in FIG. 3A, has eight strain gauges located on the annular surface 301. The strain gauges include four weight strain gauges 311, 312, 313, and 314, and four torque strain gauges 321, 322, 323, and 324. The weight strain gauges 311-314 are disposed along the vertical and horizontal axis, and the torque strain gauges 321-324 are disposed in between the weight strain gauges 311-314. FIG. 3B shows the load cell 300 disposed in a drill collar 331. When the drill collar 331 is deformed as a result of downhole forces, the load cell 300 disposed in the drill collar is also deformed, allowing the deformation to be measured with the strain gauges.

Other examples of load cells and/or strain gauges may be found in U.S. Pat. No. 5,386,724 and pending U.S. patent Ser. No. 10/064,438, both assigned to the assignee of the present invention. Load cells typically can be constructed of a material that has very little residual stress and is more suitable for strain gauge measurement. Many such materials, may include for example INCONEL X-750, INCONEL 718 or others, known to those having skill in the art.

Despite the advances in strain gauges, there remains a need to provide techniques capable of taking accurate measurements under severe downhole drilling conditions. Conventional sensors are often sensitive to bending about the drill collar axis. Additionally, conventional sensors are often sensitive to temperature fluctuations often encountered in the wellbore, such as gradients over the wall of the drill collar at the sensor location and uniform temperature rises from ambient temperature.

It is desirable that a system be provided that is capable of eliminating interferences generated by forces acting on the drill string between the drill bit and the surface. It is further desirable that such a technique magnify the deformations received for ease of measurement and/or manipulation. It is preferable that such a system be capable of operating with sufficient accuracy despite temperatures fluctuations experienced in the drilling environment, and of eliminating the effects of hydrostatic pressure on measurement readings. The present invention is provided to address the need to develop systems capable of improving measurement reliability resulting from wellbore interference, mounting problems and/or temperature fluctuations, among others.

What is still needed, however, is a more accurate and reliable load sensor with a long working life that is not affected by downhole working conditions.

SUMMARY OF INVENTION

The invention relates to a force measurement system for a downhole drilling tool. These systems provide a means for amplifying a mechanical deformation of the drill collar, and a deformation sensing element disposed on the means for amplifying the mechanical deformation.

In at least one aspect, the invention relates to an apparatus for measuring forces on a downhole drilling tool suspended in a wellbore via a drill string. The apparatus includes a drill collar operatively connectable to the drill string, the drill collar adapted to magnify deformation resulting from forces received thereto. The sensor is adapted to measure deformation of the drill collar whereby forces on the drilling tool are determined. In various aspects, the invention may relate to a force measurement system, a strain gauge system, and a drilling jar system.

The force measurement system uses a pair of plates and a dielectric, the plates positioned a distance apart with the dielectric therebetween. The system may use capacitance, Linear Variable Differential Transformer, Impedance, Differential Variable Reluctance, Eddy Current, and/or Inductive Sensor.

The strain gauge system uses a strain gauge positioned on the drill collar. A sleeve is positioned about the drill collar. The drill collar may be provided with a partial cut therethrough whereby the drill collar acts as a spring, or separated into portions. The sleeve may be used to connect portions of the drill collar. Alternatively, the strain gauge may be mounted on a housing positioned inside the drill collar.

The drilling jar system includes a drill collar having first and second portions and an elastic element therebetween. In some cases, a sleeve is used to connect the portions and define a cavity therebetween. The sensor is adapted to measure pressure changes in the cavity.

In another aspect, the invention relates to a method of determining a load acting on a downhole tool. The method includes determining an electrical property of a sensor disposed in the downhole tool when the load is applied to the downhole tool, and determining a magnitude of the load based on a difference between the electrical property of the sensor when the drill collar is in a loaded condition and the electrical property of the sensor when the drill collar is in a relaxed condition. The electrical property of the sensor is changed because the load causes a change in one selected from a relative position of a first and a second element of the sensor and an area between the first and second element. The method may also include determining an amount of deformation of the downhole tool when the tool is in a loaded condition, transmitting the measurements from the sensors to surface analyzing the measurements to determine forces on the downhole tool and/or making drilling decisions based on the analyzed measurements.

In another aspect, the invention relates to a downhole sensor for measuring a load on a downhole drilling tool suspended in a wellbore via a drill string. The sensor includes a first sensor element positioned in the downhole tool, and a second sensor element positioned in the downhole tool. The first sensor element and the second sensor element are coupled to the dowhhole tool such that one selected from a relative position of the first and second element and an area between the first and second element is changed when the drilling tool is subject to the load.

Other aspects and advantages of the invention will be apparent from the following description and the appended claims.

DETAILED DESCRIPTION

Figure 2:
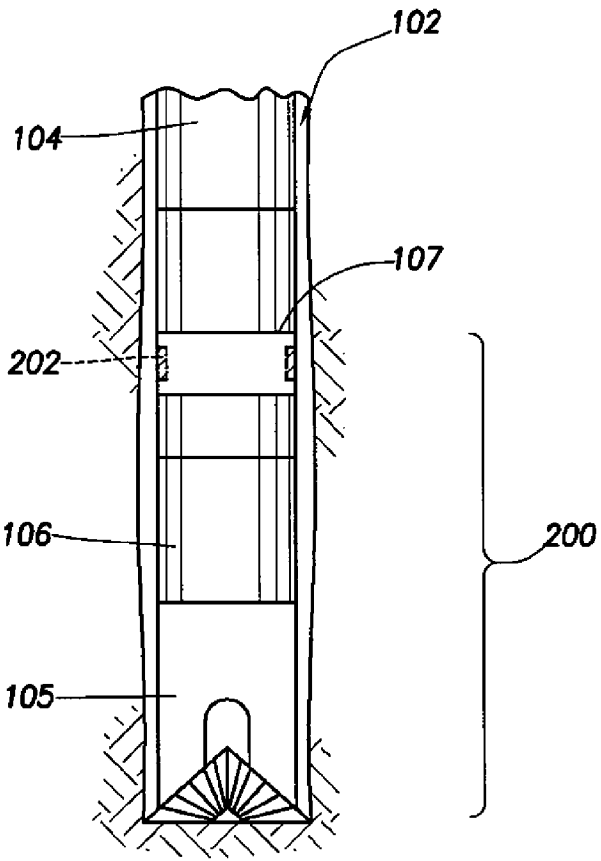
FIG. 2 shows the bottom hole assembly of FIG. 1.
Figure 1:
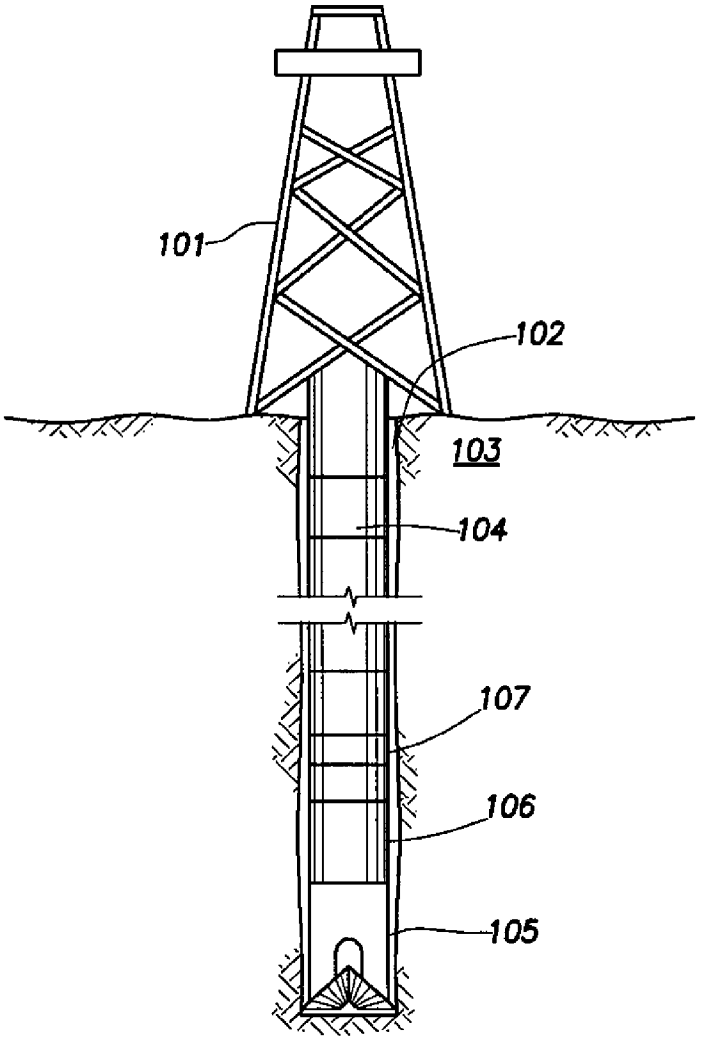
FIG. 1 shows partial cross section of a drilling system including a drilling tool with a bottom hole assembly.
Figure 3B:
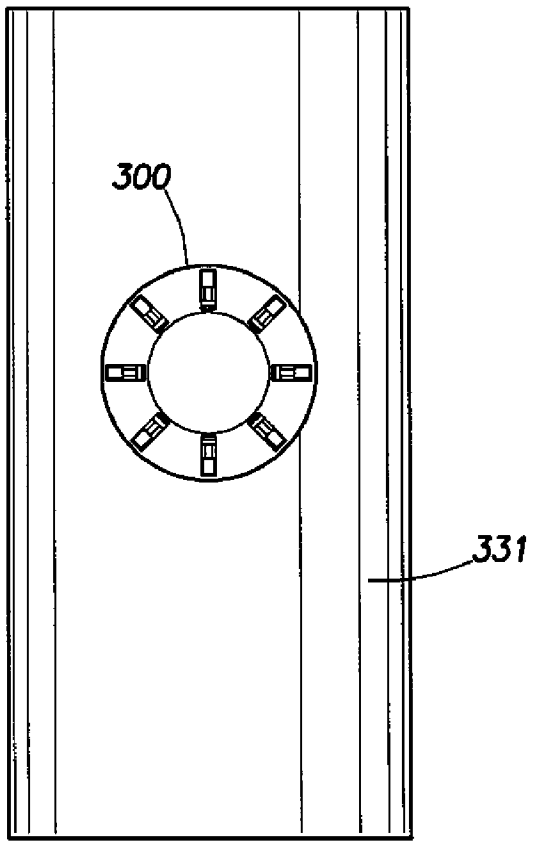
FIG.3B (PRIOR ART)
FIG. 3B shows a plan view of the prior art load cell of FIG. 3A positioned in a drill collar.
Figure 3A:
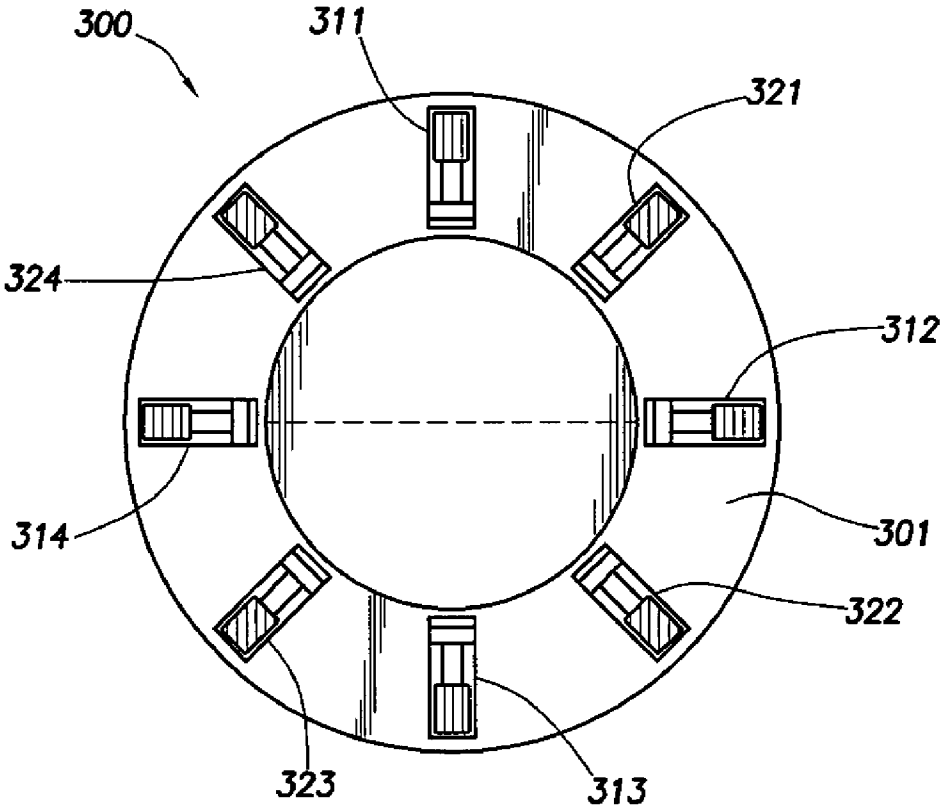
FIG.3A (PRIOR ART)
FIG. 3A shows a plan view of a prior art load cell.

FIGS. 1 and 2 depict a conventional drilling tool and wellbore environment. As discussed previously, the conventional drilling tool includes a drill string 104 suspended from a drilling rig 101. The drill string is made up of a plurality of drill collars (sometimes referred to a drill pipes), threadably connected to form the drill string. Each of the drill collars have a passage therethrough (not shown) for flowing drilling mud from the surface to the drill bit. Some such drill collars, such as the BHA 200 FIG. 2) and/or drill collar 107, are provided with circuitry, motors or other systems for performing downhole operations. In the present invention, one or more of these drill collars may be provided with systems for taking downhole measurements, such as WOB, TOB and Bend. Additional parameters relating to the downhole tool and/or downhole environment may also be determined.

Force Sensing Systems:

FIGS. 4A-14C and 16A-18E relate to various force sensing systems positionable in one or more drill collars for determining forces on the drilling tool, such as WOB, TOB and Bend. In each of these embodiments, the systems are positioned on, in or about a drill collar for measuring the desired parameters.

FIGS. 4A-10B depict various embodiments of a capacitive system having conductive plates facing each other. The capacitive system of these figures is used to determine forces on the drilling tool, such as WOB, TOB and Bend. The faces are preferably, but not always, parallel to each other and perpendicular to the direction of loading.

Figure 4B:
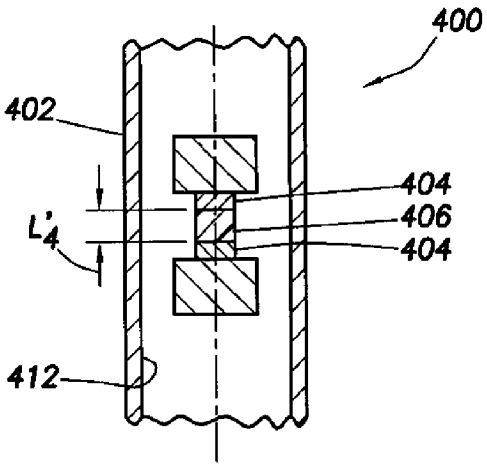
FIG. 4B shows the downhole sensor system of FIG. 4A with a force applied thereto.
Figure 4A:
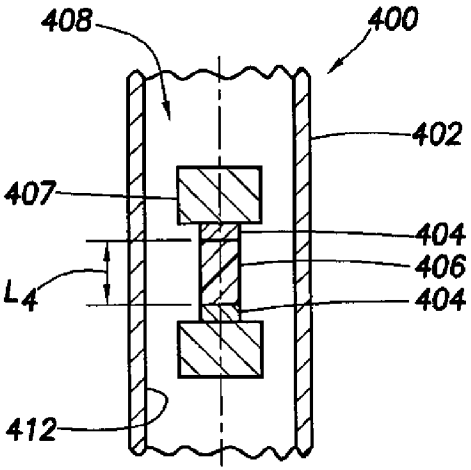
FIG. 4A shows a schematic, longitudinal cross section of a downhole sensor system that may be used for measuring WOB.

FIGS. 4A-4B depict a capacitive system 400. The capacitive system is disposed in a drill collar 402 operatively connectable to a conventional drilling string, such as the drilling string 104, and usable in a conventional drilling environment, such as the environment depicted in FIGS. 1 and/or 2. The capacitive system 400 is used to measure the deformation caused by WOB forces acting on a drill string.

The capacitive system 400 includes two face plates 404 and a dielectric 406. Preferably, as depicted in FIGS. 4A and 4B, the plates 404 and dielectric 406 are positioned in a passage 408 extending through the drill collar 402. The passage 408, used for flowing drilling mud therethrough, is defined by the inner surface 412 of the drill collar 402. The inner surface 412 defines a platform 407 capable of supporting the plates 404 and dielectric 406. As shown in FIGS. 4A and 4B, the plates 404 and dielectric 406 are positioned collinearly with the acting WOB forces of the drill collar 402. The plates 404 may be mounted in the drill collar 402 such that they parallel to each other, or facing each other within the defined distance $L_4$.

In some embodiments provided herein, various plates are positioned in the drill collar on various supports (in some cases shown). However, the configuration of the support is not intended to be restrictive of the invention.

The face plates 404 are preferably made of conductive material, such as steel or other conductive metal(s). The plates 404 are also preferably placed opposite each other a distance $L_4$ apart. The dielectric 406 may be any conventional dielectric and is positioned between the plates 404. The plates 404 are positioned in such a manner that will allow them to exhibit a derived physical property called capacitance.

Capacitance describes the ability of a system of conductors and dielectrics to store electrical energy when a potential difference exists. In a simple system, this capacitance, C, is related to the area of the two faces, A, the distance between the two faces, L, and the dielectric constant of the material between the two faces, $\in_r$ as follows:

$$C = \frac{\varepsilon_0 \varepsilon_r A}{L} \qquad \text{Equation 1}$$

where $\in_0$ is the dielectric constant of a vacuum. The dielectric constant is related to the ability of a material to maintain an electric field. Typically, the dielectric constant is constant or predictable. Thus, the capacitance of this system can be changed by changing the area of the faces or the distance between the faces.

The capacitance is measured by applying a variable current to one of the faces, and measuring the resulting potential difference between the faces. This is characterized through the impedance Z of the system defined as follows:

$$Z = \frac{L}{2\pi f \varepsilon_0 \varepsilon_r A} = \frac{1}{2\pi f C} \qquad \text{Equation 2}$$

where f is the variable current frequency. Here, this concept is applied measuring the forces acting on a drill string. Forces on a drill string cause the drillstring to deform. This deformation can be transferred and captured by measuring the varying capacitance between two conductive plates within the tool string.

The capacitive system may be used to determine forces on the drilling tool, such as WOB, TOB and Bend, among others. The deformation is transferred to the measuring device through a deforming load bearing element. The length of the deforming element is captured by the changing distance between the two faces or varying L.

Some prior art sensors, such as the load cell disclosed in the Das patent (U.S. Pat. No. 5,386,724, discussed in the Background), use strain gauges to measure the deformation of the drill collar under a load. The strain gauges deform with the drill collar, and the amount of deformation can be determined from the change in the resistivity of the strain gauge. The present invention, however, use other electrical principles, such as capacitance, inductance, and impedance, to determine the forces that act on a drill collar based on the amount of deformation experienced by the drill collar when under a load.

This disclosure uses the word "force" generically to refer to all of the loads (e.g., forces, pressures, torques, and moments) that may be applied to a drill bit or a drill string. For example, use of the word "force" should not be interpreted to exclude a torque or a moment. All of these loads cause a corresponding deformation that can be measured using one or more embodiments of the invention.

The capacitance of the system 400 is defined by its configuration. Referring to FIG. 4A, the capacitor plates 404 each have a surface area that is opposed to the other plate. This defines the capacitive area of the system 400. Also, the capacitor plates 404 are separated by a distance $L_4$. A dielectric material 406 between the capacitor plates 404 has a particular electrical permittivity $\in_4$. These parameters combine to give the sensor a specific capacitance, which can be quantified using Equation 1, above.

FIG. 4B shows the system 400 under the load of WOB. The drill collar 402 deforms—in compression—and the amount of the deformation is proportional to the magnitude of the WOB. The compressive deformation of the drill collar 402 moves the capacitor plates 404 closer to each other, so that they are separated by a distance $L'_4$. The distance $L'_4$ in FIG. 4B is shorter that the distance $L_4$ in FIG. 4A because of the compressive deformation.

The plates 404 move with respect to each other because they are coupled to the drill collar 402 at different axial points along the drill collar 402. Any deformation of the drill collar 402 will cause a corresponding change in the distance $L_4$ between the plates 404.

Equation 1, above, shows that reducing the distance between the capacitor plates 404 (i.e., from $L_4$ to $L'_4$) will cause an increase in the capacitance C of the system 400. Detecting the increase in capacitance will enable the determination of the deformation, which will, in turn, enable a determination of the WOB. In some cases, for example, when a computer is used to calculate the WOB, the WOB may be determined from change in capacitance without specifically determining the deformation. Such embodiments do not depart from the scope of the invention.

In FIGS. 4A and 4B, the plates 404 are substantially parallel to each other. In other embodiments, the plates may not be parallel to each other. Those having ordinary skill in the art will be able to devise other configurations of plates without departing from the scope of the present invention.

In FIG. 4B, the capacitor plates 404 are arranged substantially perpendicular to the direction in which the WOB acts (i.e., the plates 404 are positioned substantially horizontally and the WOB acts substantially vertically). In this arrangement, the movement of the capacitor plates 404 is at a maximum for the deformation of the drill string 402 because of WOB. While this arrangement is advantageous, it is not required by all embodiments of the invention.

It will be understood that the description of relative position of the plates to each other (e.g., substantially parallel) and the position of the plates relative to the direction of the load to be measured (e.g., perpendicular) will apply to other embodiments of the invention. As will be described, other sensors may have plates that are parallel to each other and perpendicular to the direction of the load to be measured. Furthermore, while such arrangements are advantageous, they are not required by all embodiments of the invention, as will be understood.

In some cases, the capacitance in the system is determined by connecting the system in a circuit with a constant current AC power source. The changes in the voltage across the sensor will enable the determination of the capacitance, based on the known value of the AC current source.

In some cases, the change in voltage across the sensor plates is used to determine the change in the impedance of the sensor. Impedance, usually denoted as Z, is the opposition that a circuit element offers to electrical current. The impedance of a capacitor is defined in Equation 2, above. The change in impedance will affect the voltage in accordance with Equation 3:

$$V=IZ_{CAP} \qquad \text{Equation 3}$$

where $Z_{CAP}$ is the impedance of the capacitor (e.g., system 400). Thus, the change in the voltage across the system 400 will indicate a change in impedance, which, in turn, indicates a chance in capacitance. The magnitude of the change in capacitance is related to the deformation, which is related to the WOB.

A sensing system 400 may be located in an MWD collar (e.g., 106 in FIG. 2) in a BHA (e.g., 200 in FIG. 2). In another arrangement, a system is located in a separate collar, such as drill collar 107 shown in FIGS. 1 and 2. The location of the sensor in a drilling system is not intended to limit the invention.

Another term used to describe measurements that are made during the drilling process is "logging-while-drilling" ("LWD"). As is known in the art, LWD usually refers to measurements related to the properties of the formation and the fluids in the formation. This is contrasted with MWD, which usually refers to measurements related to the drill bit, such as borehole temperature and pressure, WOB, TOB, and drill bit trajectory. Because one or more embodiments of the invention relate to measuring forces on a drill bit, the term "MWD" is used in this disclosure. It is noted, however, that the distinction is not germane to this invention. The use of MWD is not intended to exclude the use of embodiments of the invention with LWD drilling tools.

Capacitance is an example of a technique in conjunction with the downhole measurement system. Other non-contact displacement measurement devices may also be used in place of capacitance, such as Linear Variable Differential Transformer, Impedance, Differential Variable Reluctance, Eddy Current, or Inductive Sensor. Such techniques may be implemented by using two coils within a housing to form sensing and compensation elements. When the face of the transducer is brought in close proximity to a ferrous or highly conductive material, the reluctance of the sense coil is changed, while the compensation coil acts as a reference. The coils are driven by a high frequency sine wave excitation, and their differential reluctance is measured using a sensitive de-modulator. Differencing the two coils outputs provides a sensitive measure of the position signal, while canceling out variations caused by temperature. Ferrous targets change the sense coils' reluctance by altering the magnetic circuits permeability; conductive targets (such as aluminum) operate by the interaction of eddy currents induced in the target's skin with the field around the sense coil. An explanation of an example of formulas and theories relating to this technology is available at the following website, which is incorporated herein, in its entirety, by reference:

http://web.ask.com/redir?bpg=http%3a%2f%2fweb.ask.com%2fweb%3fq%3deddy%2bcurrent%2bdisplacement%2bmeasurement%26o%3d0%26page%3d1&q=eddy+current+displacement+measurement&u=http%3a%2f%2ftm.wc.ask.com%2fr%3ft%3dan%26s%3da%26uid%3d071D59039D9B069F3%26sid%3d16C2569912E850AF3%26qid%3d2AE57B684BFE7F46ABCD174420281ABA%26io%3d8%26sv%3dza5cb0d89%26ask%3deddy%2bcurrent%2bdisplacement%2bmeasurement%26uip%3dd8886712%26en%3dte%26eo%3d-100%26pt%3dSensors%2b-%2bSeptember%2b1998%2b-%2bDesigning%2band%2bBuilding%2ban%2bEddy%2bCurrent%26ac%3d24%26qs%3d1%26pg%3d1%26ep%3d1%26te_par%3d204%26u%3dhttp%3a%2f%2fwww.sensorsmag.com%2farticles%2f0998%2fedd0998%2fmain.shtml&s=a&bu=http%3a%2f%2fvww.sensorsmag.com%2farticles%2f0998%2fedd0998%2fmain.shtml The website describes an eddy current sensor, and its use for non-contact position and displacement measurement. Operating on the principle of magnetic induction, an eddy current sensor can measure the position of a metallic target, even through intervening nonmetallic materials, such as plastics, opaque fluids, and dirt. Eddy current sensors are rugged and can operate over wide temperature ranges in contaminated environments.

Typically, an eddy current displacement sensor includes four components: (1) a sensor coil; (2) a target; (3) drive electronics; and (4) a signal processing block. When the sensor coil is driven by an AC current, it generates an oscillating magnetic field that induces eddy currents in any nearby metallic object (i.e., the target). The eddy currents circulate in a direction opposite to that of the coil, reducing the magnetic flux in the coil and thereby its inductance. The eddy currents also dissipate energy, which increases the coil's resistance. These electrical principles may be used to determine the displacement of the target from the coil.

An example of the theory relating to LVDT sensor and operation is available at the following website, which is incorporated herein, in its entirety, by reference:

http://www.macrosensors.com/primerframe.htm

In relevant part, the above website states that a linear variable differential transformer ("LVDT") is an electro-mechanical transducer that can convert rectilinear motion into an electrical signal. Depending on the particular system, an LVDT may be sensitive to movements as small as a few millionths of an inch.

A typical LVDT includes a coil and a core. The coil assembly consists of a primary winding in the center of the coil assembly, and two secondary windings on either side of the primary winding. Typically, the windings are formed on thermally stable glass and wrapped in a high permeability magnetic shield. The coil assembly is typically the stationary section of an LVDT sensor.

The moving element of an LVDT is the core, which is typically a cylindrical element that may move within the coil assembly with some radial clearance. The core is usually made from a highly magnetically permeable material.

In operation, the primary winding is energized with AC electrical current, known as the primary excitation. The electrical output of the LVDT is a differential voltage between the two secondary windings, which varies with the axial position of the core within the coil assembly.

The LVDT's primary winding is energized by a constant amplitude AC source. The magnetic flux developed is coupled by the core to the secondary windings. If the core is moved closer to the first secondary winding, the induced voltage in the first secondary winding will increase, while the induced voltage in the other secondary winding will be decreased. This results in a differential voltage.

Figure 5A:
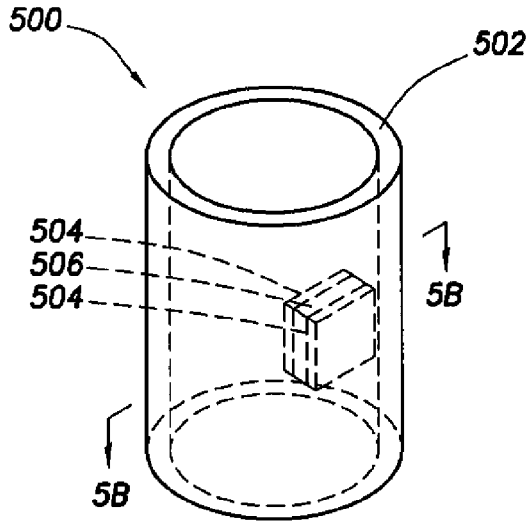
FIG. 5A shows a schematic view of an alternate downhole sensor system that may be used for measuring TOB.
Figure 5B:
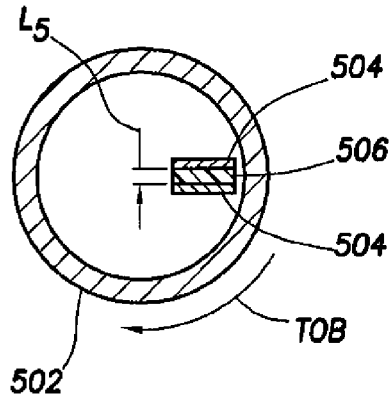
FIG. 5B shows a radial cross section of the downhole sensor system of FIG. 5A.
Figure 5C:
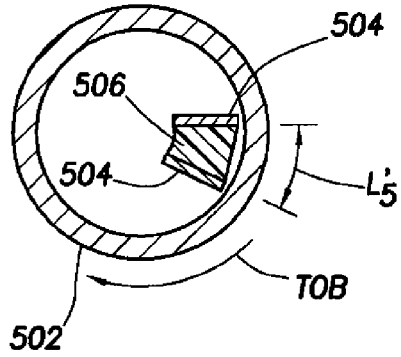
FIG. 5C shows the downhole sensor system of FIG. 5A with a force applied thereto.

FIGS. 5A-5C capture this capacitance application for a TOB-type of measuring device. FIGS. 5A-5C depict an alternate embodiment of a capacitance system 500. This system 500 is the same as the system 400, except that the system 500 includes conductive plates 504 and a dielectric 506 in an alternate configuration subject to rotative forces TOB. In this embodiment, the load bearing element is the drill collar 502 and the TOB force is transferred through the drill collar axis.

In the capacitive system 500 depicted in FIGS. 5A-5C, the plates 504 are mounted along the inner surface of the drill collar 502 on a support or mount (not shown). Each plate 504 is mounted at a different radial position and they extend radially inward toward the center of the drill collar 502. The plates 504 are positioned such that, as the tool rotates, the plates 504 move along the drill collar axis. In other words, as the tool rotates, the distance $L_5$ between the plates 504 will extend and retract in response to the TOB forces applied. FIG. 5B is a cross section along line 5B-5B in FIG. 5A. FIG. 5B depicts the distance $L_5$ between the parallel plates 504 in their initial position. FIG. 5C depicts the distance $L'_5$ between the parallel plates 504 after the rotative TOB force is applied. In this case, $L'_5$ is greater than $L_5$.

Figures 6A, 6B, 6C, 7A, 7B:
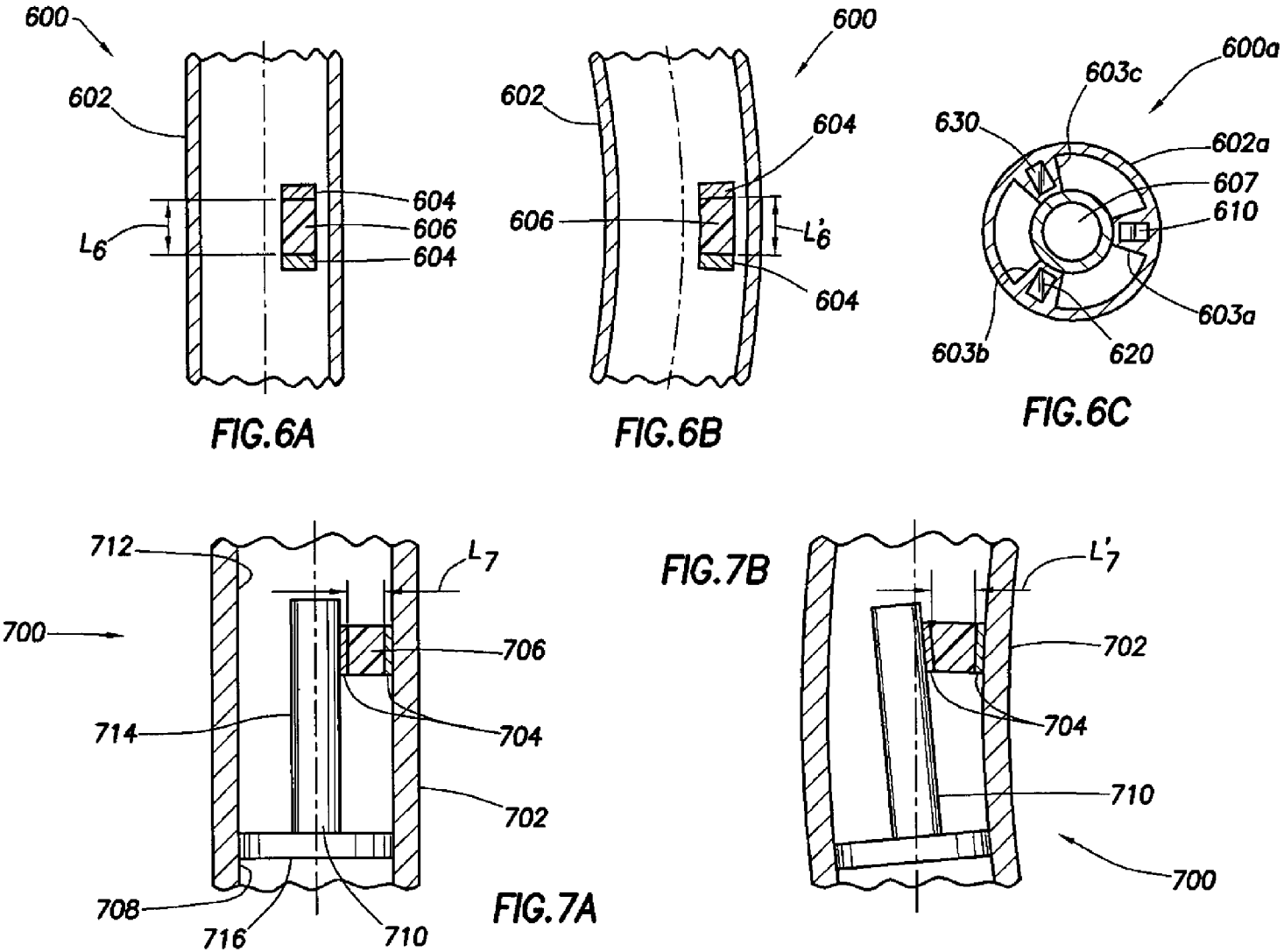
FIG. 6A shows a longitudinal cross section of an alternate downhole sensor system for measuring axial Bend.
FIG. 6B shows the downhole sensor system of FIG. 6A with a force applied thereto.
FIG. 6C shows a radial cross section of an alternate downhole sensor system for measuring TOB.
FIG. 7A shows a longitudinal cross section of an alternate downhole sensor for measuring radial Bend.
FIG. 7B shows the downhole sensor system of FIG. 7A with a force applied thereto.

FIGS. 6A and 6B capture this capacitance application for a Bending-type of measuring device. FIGS. 6A and 6B depict an alternate embodiment of a capacitance system 600. This system 600 is the same as the system 400, except that the system 600 includes conductive plates 604 and a dielectric 606 in an alternate configuration subject to axial Bend. In this embodiment, the load bearing element is the drill collar 602 and the bending is transferred as a moment along the axis of the drill collar 602.

In the capacitive system 600 depicted in FIG. 6A, the plates 604 are mounted along the inner surface of the drill collar 602 a distance $L_6$ apart along the central axis of the drill collar 602. The plates 604 are positioned perpendicular to the drill collar 602 axis such that, as the tool bends, the plates 604 move in response thereto as shown in FIG. 6B. In other words, as the tool bends, the distance $L_6$ between the plates 604 will extend and retract in response to the Bending forces applied. FIG. 6B depicts the system 600 and the resulting distance $L'_6$ between the plates 604 after the Bending force is applied.

The one or more of the systems described above are located along the axis of a drill collar. In this location, the sensors systems are responsive to deformations resulting from WOB. In some cases, they may have the added advantage of not being sensitive to Bend. With the sensor system in FIG. 4A, for example, the effect of WOB will be to move all parts of the capacitor plates 404 closer together. If the drill collar 402 were to bend, however, the effect would be to move the plates 404 closer together on one half of the sensor 400 and farther apart on the other half of the sensor 400. This effect will cancel out the effect of Bend, making the sensor 400 substantially insensitive to Bend.

FIGS. 6A and 6B, described above, show a system 600 that is located away from the axis of the drill collar 602. Instead, the system 600 is located in a position so that it is able to detect drill string bend.

FIG. 6C shows a radial cross section of another drill collar 602*a*. The drill collar 602*a* is the same as in FIGS. 6A and 6B, except that the drill collar 602*a* includes three drill collar systems 610, 620, 630. Each drill collar system 610, 620, 630 in FIG. 6C is located in a leaf 603*a*, 603*b*, 603*c* of the drill collar 602*a* and is able to detect downhole loads. A center portion or hub 607 of the drill collar 602*a* may house other sensors or equipment. When the drill collar 602*a* experiences compressive deformation, due to the WOB for example, the systems 610, 620, 630 will each have a similar change in capacitance. When the drill collar 602*a* bends, however, at least one of the systems 610, 620, 630 will experience an increase in the distance between the plates (thus, a decrease in capacitance), and at least one of the systems 610, 620, 630 will experience a decrease in the distance between the plates (thus, an increase in capacitance). Depending on the direction of the bend, the third sensor may experience either compression or expansion from the Bend. Using all three systems 610, 620, 630 in a drill collar 602*a* enables the simultaneous determination of both WOB and bend.

FIGS. 7A-7D capture this capacitance application for another Bending-type of measuring device. FIGS. 7A-7B depict an alternate embodiment of a capacitance system 700. This system 700 is the same as the system 600, except that the system includes a conductive plates 704 and a dielectric 706 in an alternate configuration subject to radial Bending forces. Additionally, a platform 710 is positioned within the drill collar to support the plates 704. In this embodiment, the load bearing element is the drill collar 702 and the Bend is transferred as a moment along the axis of the drill collar.

In the capacitive system 700 depicted in FIG. 7A, the plates 704 are mounted on the platform 710 positioned in the passage 708. The platform 710 has a base portion 716 mounted on the inner surface 712 of the drill collar 702, and a shaft portion 714 extending from the base portion 716 along the central axis of the drill collar 702. One of the plates 704 is positioned on the central shaft 714, another plate 704 is positioned on the inner surface 712 a distance $L_7$ from the first plate. The plates 704 are positioned parallel to the drill collar axis such that, as the tool bends, the plates 704 move in response thereto as shown in FIG. 7B. In other words, as the tool bends, the distance $L_7$ between the plates 704 will extend and retract in response to the radial Bending forces applied. As shown in FIG. 7B, a Bending force applied to the drill collar 702 shifts the position of the drill collar 702 and platform 710 together with the respective plates 704 positioned thereon. The distance $L_7$ results from the movement of the system 700.

Figure 7C:
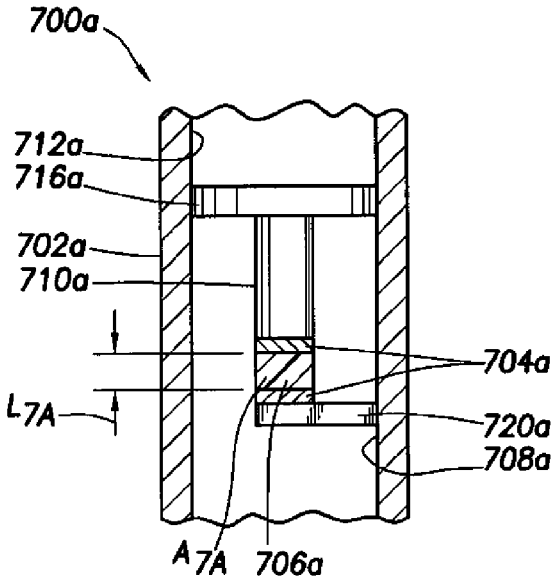
FIG. 7C shows a longitudinal cross section of an alternate downhole sensor system for measuring radial Bend having platforms mounted to the drill collar for supporting dielectric plates.
Figure 7D:
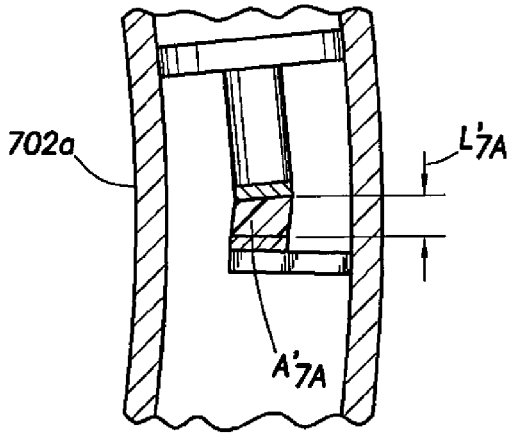
FIG. 7D shows the downhole sensor system of FIG. 7C with a force applied thereto.

FIGS. 7C-7D depict an alternate embodiment of a capacitance system 700*a*. This system 700*a* is the same as the system 700, except that the system 700*a* includes conductive plates 704*a* and a dielectric 706*a* in an alternate configuration subject to radial Bend. Additionally, a platform 710*a* and support 720*a* are positioned within the drill collar to support the plates 704*a*. In this embodiment, the load bearing element is the drill collar 702*a*.

In the capacitive system 700*a* depicted in FIG. 7C, the plates 704*a* are mounted on the platform 710*a* positioned in the passage 708*a*. The platform 710*a* has a base portion 716*a* mounted on the inner surface 712*a* of the drill collar, and a shaft portion 710*a* extending from the base portion along the central axis of the drill collar. One of the plates 704*a* is positioned on the central shaft, another plate 704*a* is positioned on the support 720 mounted on the inner surface 712*a* a distance $L_{7A}$ from the first plate with a projected area of $A_{7A}$ between them. The plates 704*a* are positioned perpendicular to the drill collar axis such that, as the tool bends, the plates 704*a* move parallel to each other in response thereto as shown in FIG. 7D. In other words, as the tool bends, the distance $L_{7A}$ between the plates 704 will extend and retract in response to the radial Bend applied. In addition, the parallel motion of the plates changes the area between the plates to $A'_{7A}$. As shown in FIG. 7D, a Bend applied to the drill collar 702*a* shifts the position of the drill collar 702*a* and platform together with the respective plates positioned thereon. The distance $L'_{7a}$ and the area $A'_{7A}$ result from the movement of the system.

Figure 8A:
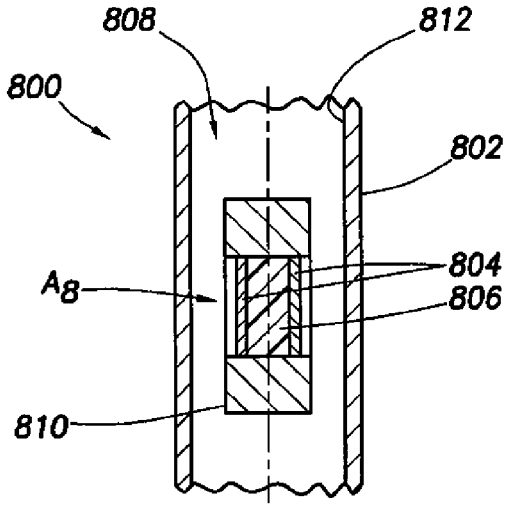
FIG. 8A shows a longitudinal cross section of an alternate downhole sensor system for measuring WOB using plates parallel to the axis of force.
Figure 8B:
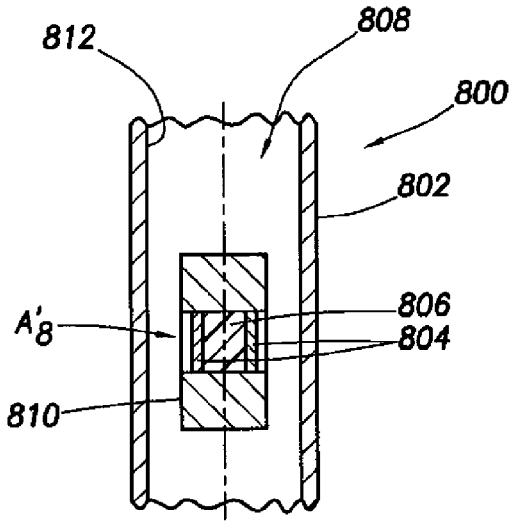
FIG. 8B shows the downhole sensor system of FIG. 8A with a force applied thereto.

Referring now to FIG. 8A-8B, an embodiment of a capacitive system having conductive plates parallel to each other and placed parallel to the axis of loading is depicted. The deformation is captured by the changing area of projection between the two plates as they move relative to each other. These figures capture the capacitive application for a WOB-type of measuring device. FIGS. 5A and 8B depict an alternate embodiment of a capacitance system 800. This system 800 is the same as the system 400, except that the system 800 includes a conductive plates 804 and a dielectric 806 in an alternate configuration. In this embodiment, the load bearing element is the drill collar 802 and the WOB force is transferred through the drill collar axis.

In the capacitive system 800 depicted in FIG. 5A, the plates 804 are mounted on a platform 810 positioned in a passage 808 defined by the inner surface 812 of the drill collar 802. The platform 810 supports the plates 804 therein with an area $A_8$ therebetween. The plates 804 are positioned such that, as WOB is applied to the tool, the plates 804 deform along the drill collar axis in response thereto. In other words, as the tool is compressed or extended, the area $A_8$ between the plates 804 will change in response to the WOB forces applied. The deformation is captured by the conductive plates 804 deforming in proportion to the deformation of the load bearing element. As shown in FIG. 8B, the face is then deformed in relation to deformation of the load bearing element resulting in an altered area $A'_8$.

Figure 9A:
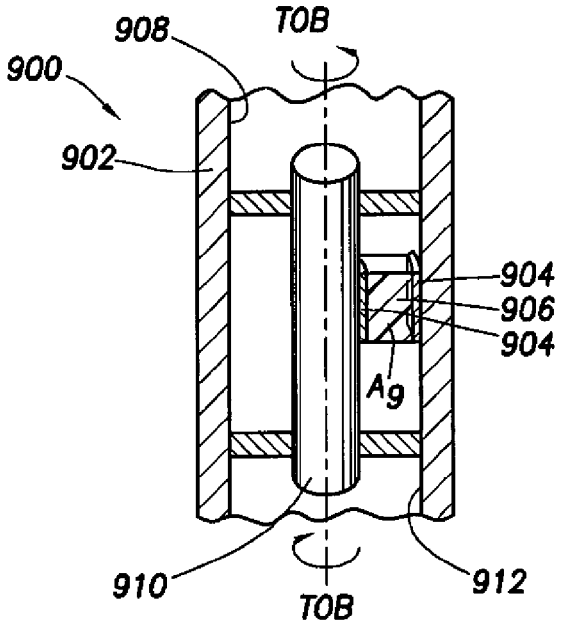
FIG. 9A shows a longitudinal cross section of an alternate downhole sensor system for measuring TOB having conductive plates that move opposite each other.
Figure 9B:
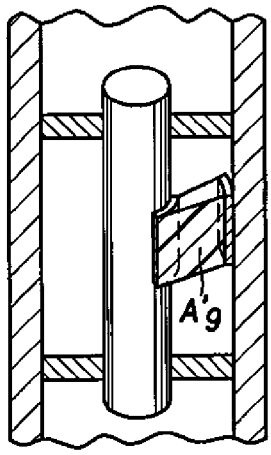
FIG. 9B shows a longitudinal cross section of the downhole sensor system of FIG. 9A with a force applied thereto.

Referring now to FIG. 9A-10B, an embodiment of a capacitive system having conductive plates parallel to each other and moving in opposite direction relative to each other is depicted. The deformation is captured by the changing area of projection between the two plates as they move past each other. FIGS. 9A and 9B capture this application for a TOB-type of measuring device. FIG. 9 depicts an alternate embodiment of a capacitance system 900. This system 900 is the same as the system 400, except that the system 900 includes a conductive plates 904 and a dielectric 906 in an alternate configuration. In this embodiment, the load bearing element is the drill collar 902 and the TOB force is transferred through the drill collar axis.

In the capacitive system 900 depicted in FIGS. 9A and 9B, a platform 910 is positioned in a passage 908 defined by the inner surface 912 of the drill collar 902. The platform 910 is mounted to the inner surface 912 and extends through the passage 908 of the drill collar 902. A first plate is positioned on the platform 910, and the second plate is positioned adjacent the first plate on the inner surface 912 of the drill collar 902. The plates 904 are preferably parallel with an area $A_9$ therebetween. The plates 904 are positioned such that, as TOB is applied to the tool, the drill collar 902 deforms radially and the plates move relative to the deformation in response thereto. In other words, as forces are applied to the drill collar 902, the plates 904 will rotate relative to each other about the drill collar axis in response to the TOB forces applied. The deformation of the drill collar 902 is then captured by the change in overlapping projected area of the sensor. The overlapping area changes in response to the drill collar deformation. FIG. 9A depicts the position of the plates and the area $A_9$ between the plates 904 before the TOB is applied. FIG. 9B depicts the position of the plates and the area $A'_9$ between the plates 904 before the TOB is applied.

Figure 10A:
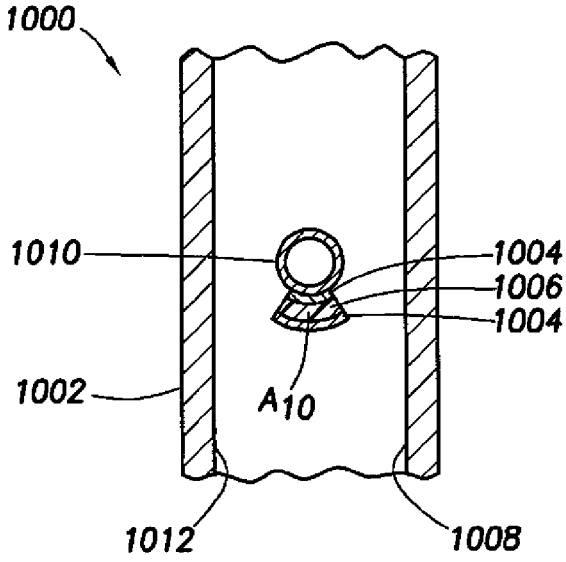
FIG. 10A shows a longitudinal cross section of an alternate downhole sensor system for measuring Bend having conductive plates that rotate relative to each other.
Figure 10B:
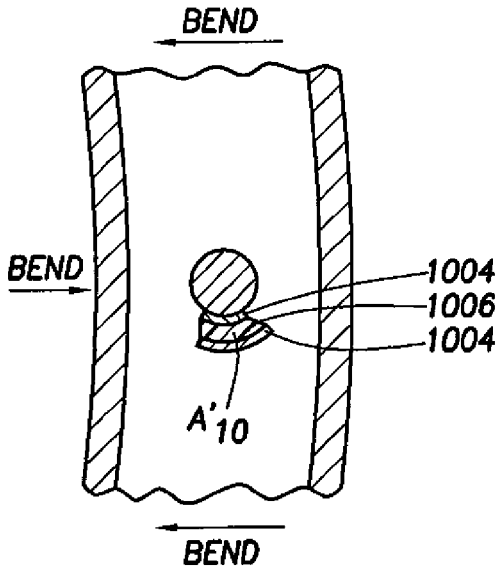
FIG. 10B shows the downhole sensor system of FIG. 10A with a force applied thereto.

FIGS. 10A and 10B capture this capacitance application for a Bending-type of measuring device. FIG. 10 depicts an alternate embodiment of a capacitance system 1000. This system 1000 is the same as the system 400, except that the system 1000 includes conductive plates 1004 and a dielectric 1006 in an alternate configuration. In this embodiment, the load bearing element is the drill collar 1002 and the Bend transferred as a moment along the axis of the drill collar.

In the capacitive system 1000 depicted in FIGS. 10A and 10B, the plates 1004 are mounted on a platform 1010 positioned in a passage 1008 defined by the inner surface 1012 of the drill collar 1002. The platform 1010 supports the plates 1004 therein with an area $A_{10}$ therebetween. The plates 1004 are positioned such that, as Bending is applied to the tool, the plates 1004 deform radially to the drill collar axis in response thereto. In other words, as the tool is bent, the plates 1004 will rotate relative to each other about the bending moment and the area $A_{10}$ will change in response to the Bending forces applied. The deformation of the drill collar 1002 is then captured by the change in overlapping projected area of the sensor. The overlapping area changes in response to the drill collar 1002 deformation.

As shown in FIGS. 4A-10B, the capacitive system is contained within a single drill collar. However, the system may be positioned in other positions within the drilling tool, or across multiple drill collars. Additionally, more than one system may be contained within a single drill collar and/or positioned to provide measurements for more than one type of force. Other sensors may be combined within one or more of these systems to provide measurements including, for example downhole pressures, temperature, density, gauge pressure, differential pressure, transverse shock, rolling shock, vibration, whirl, reverse whirl, stick slip, bounce, acceleration and depth, among others. Transmitters, computers or other devices may be linked to the sensors to allow communication of the measurements to the surface (preferably at high data rates), analysis, compression, or other processing to generate data and allow action in response thereto.

Strain Gauge

FIGS. 11A-12B depict various strain gauge systems usable in a drilling tool. Each of these embodiments incorporates a drill collar connectable to a drill string, such as the drill string of FIGS. 1 and 2, for measuring downhole forces, such as WOB, TOB and Bend, on a drilling tool.

FIGS. 11A-11D depict a strain gauge system 1100 including a drill collar 1102 having a helical cut or gap 1106 therethrough, and a strain gauge 1104. The drill collar 1102 may be provided with threadable ends (not shown) for operative connection to a drill string, such as the drill string of FIGS. 1 and 2.

The helical cut 1106 in the drill collar is used to magnify the forces applied to the drill collar and/or reduce the effect of hydrostatic pressure on measurement readings. The axial force present in the drill collar due to weight on bit can be transformed into a torsional moment. The shear strain due to the torsional moment can be measured and is a linear function of the weight applied in the direction of the axis of the drill collar.

Figure 11B:
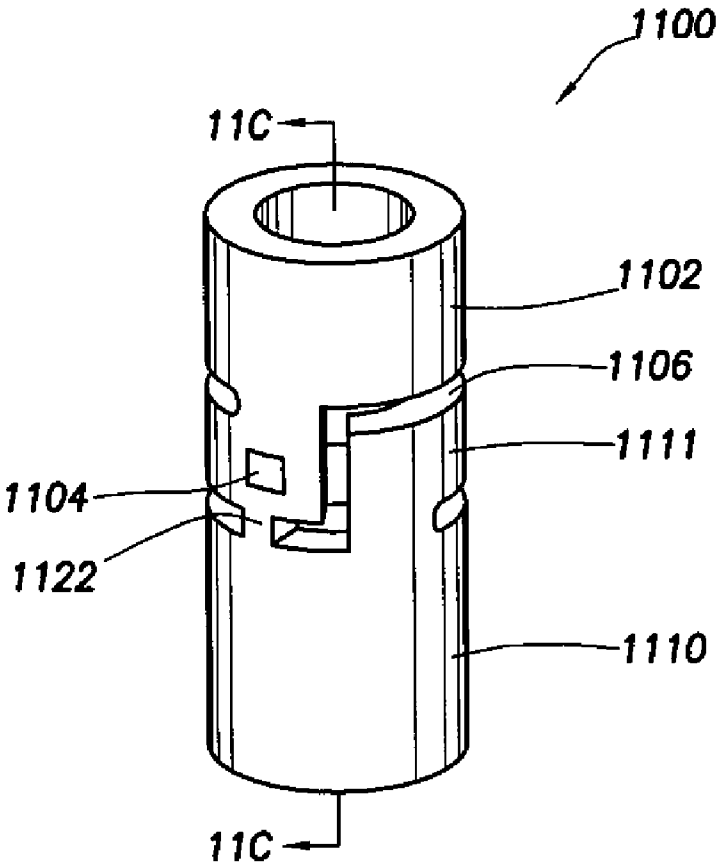
FIG. 11B shows a perspective view of the downhole sensor system of FIG. 11A.
Figure 11A:
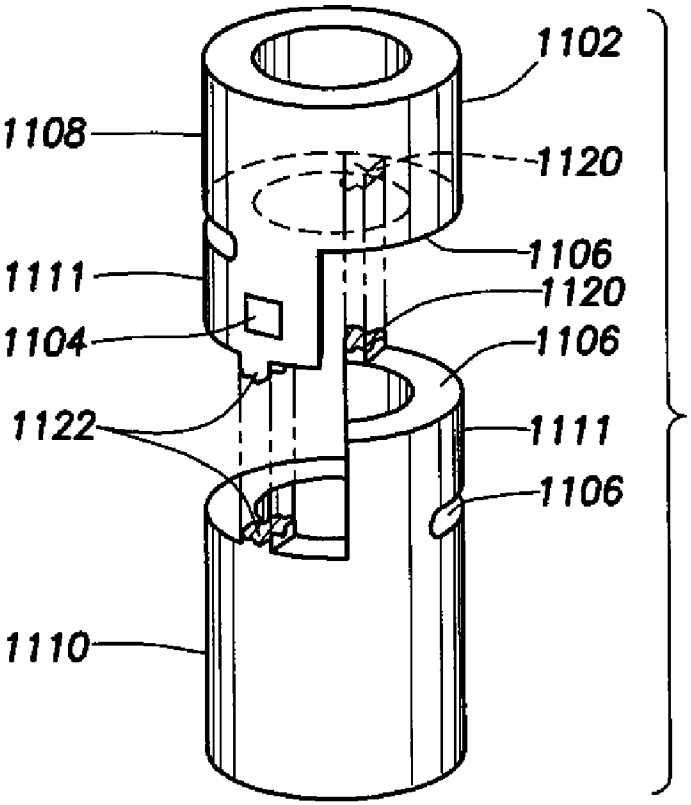
FIG. 11A shows a cut perspective view of an alternate downhole sensor system using a strain gauge system with a helical cut.

The gap 1106 preferably extends about a central portion of the drill collar to partially separate the drill collar into a top portion 1108, a bottom portion 1110 and a central portion 1111 therebetween. The gap extends through the wall of the drill collar to enable greater deformation of the drill collar in response to forces resulting in a spring-like movement. Preferably, as shown by the dotted lines in FIG. 11A, a portion of the drill collar remains united at sections 1120 and 1122 to secure the portions of the drill collar together. As shown in FIG. 11B, the gap is helically disposed about a central portion of the drill collar. However, other geometries or configurations are envisioned.

Figure 11C:
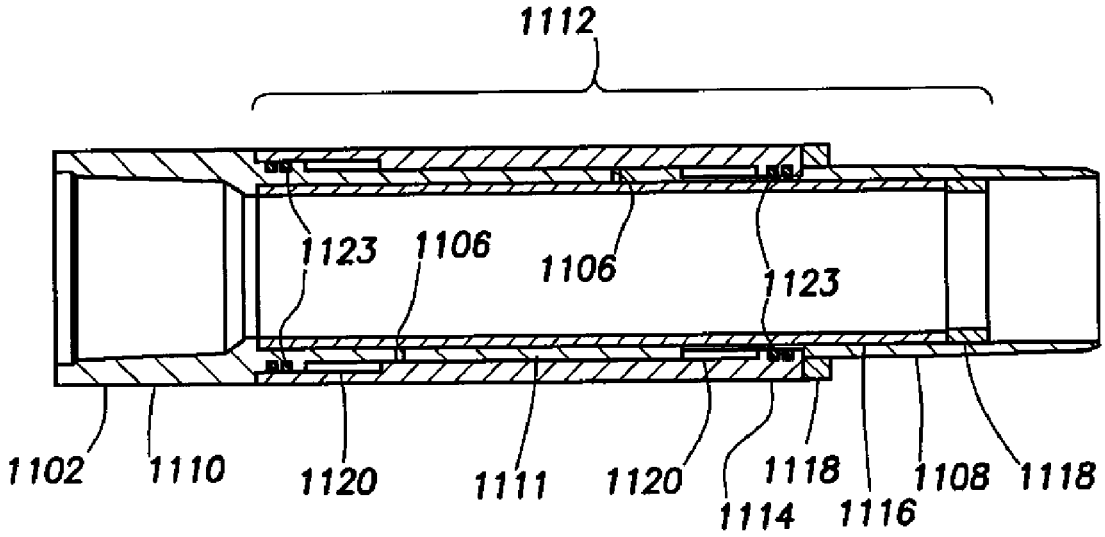
FIG. 11C is a cross section of a portion of the downhole sensor system of FIG. 11A.
Figure 11D:
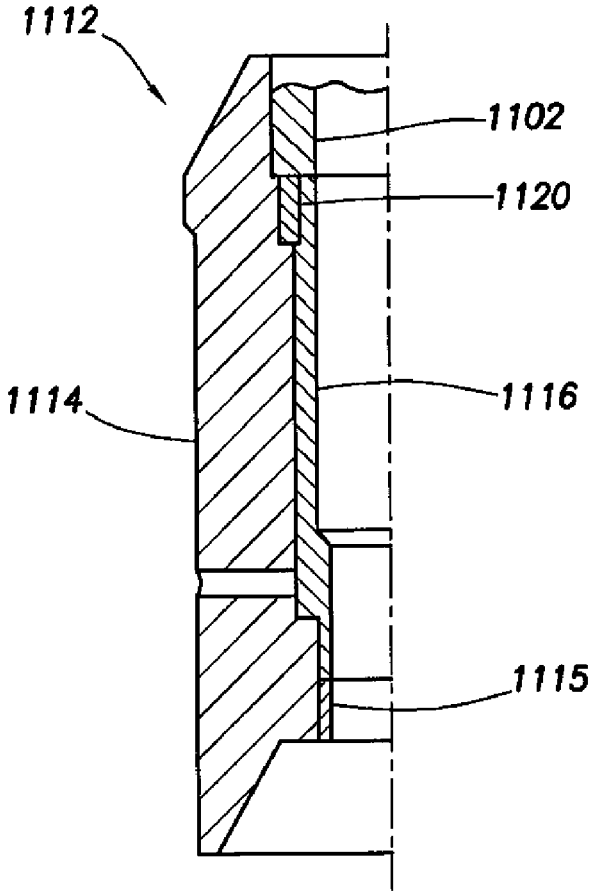
FIG. 11D is a longitudinal cross section of the downhole sensor system of FIG. 11A.

With the gap, the ability of the drill collar to transfer the torque necessary for drilling may be reduced. To provide the necessary torque, a load sleeve is secured to the drill collar. As shown in FIGS. 11C and 11D, a sleeve 1112 is preferably positioned about the drill collar along the gap. The sleeve 1112 includes an outer portion 1114, a sleeve 1116, thread rings 1118 and a torque transmitting key 1120. A locking nut 1115 may also be provided to secure the sleeve to the drill collar. Seals 1123 are also provided to prevent the flow of fluid through the sleeve. The sleeve 1116 is preferably mounted on the inside of the drill collar along the gap.

The outer portion 1114 is disposed about the outer surface of the drill collar to assist in securing the portions of the drill collar together. The outer portion transmits torque applied to the drill collar and reduces axial forces. The outer portion may also prevent mud from flowing into the drill collar through the gap. The inner portion 1116 is positioned along the inner surface of the drill collar to isolate the drill collar from drilling mud. The inner portion also insulates the drill collar from temperature fluctuations. The thread rings 1118 and locking nut 1115 are positioned on the inner and outer surfaces of the drill collar adjacent the portions of the sleeve to secure the sleeve in place about the drill collar.

Torque transmitting keys 1120 are preferably positioned about the outer surface of the drill collar adjacent the outer portion. A first key transmits the torque from the top part of the drill collar to the sleeve. The second key transmits the torque from the sleeve to the lower drill collar. The keys are preferably provided to allow axial movement and/or to separate the internal and the external mud flow.

A strain gauge 1104, such as a metal foil strain gauge, is preferably positioned at 45 degrees to the collar axis to measure shear strains which are a function of the WOB, TOB and Bend desired to be measured.

Figure 12B:
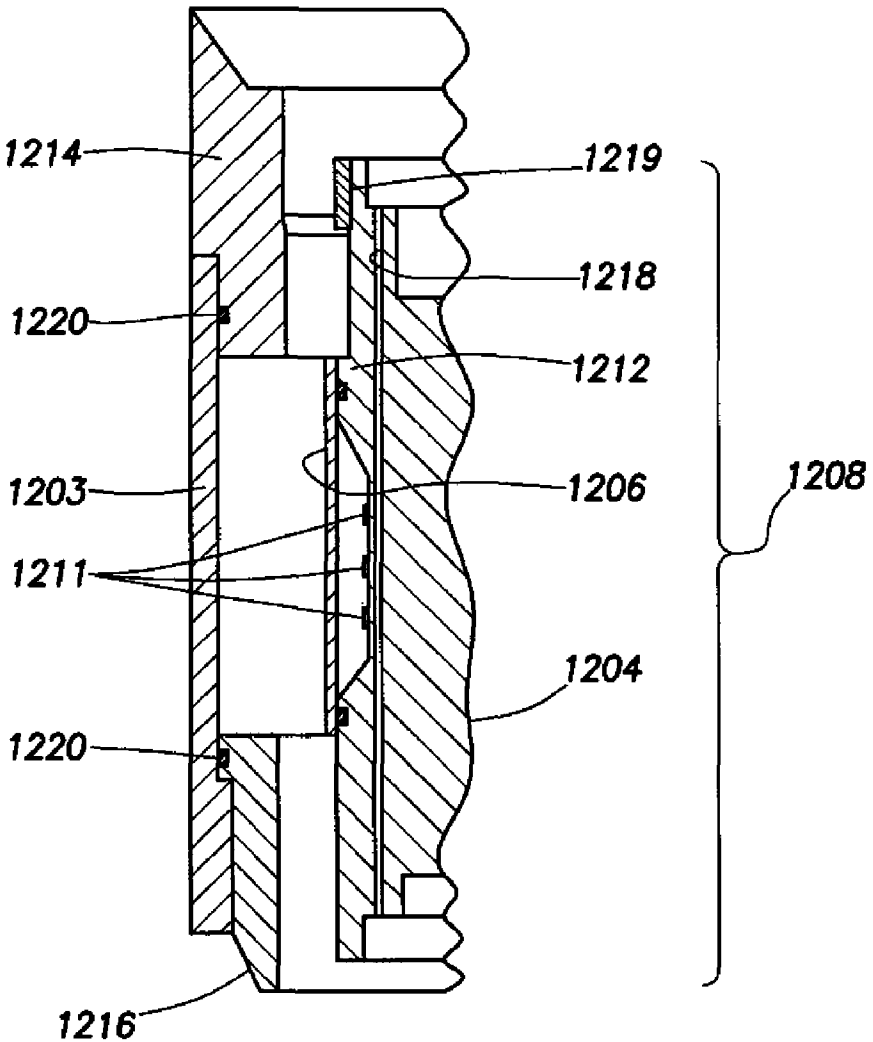
FIG. 12B shows a cross section of a portion of the downhole sensor system of FIG. 12.
Figure 12A:
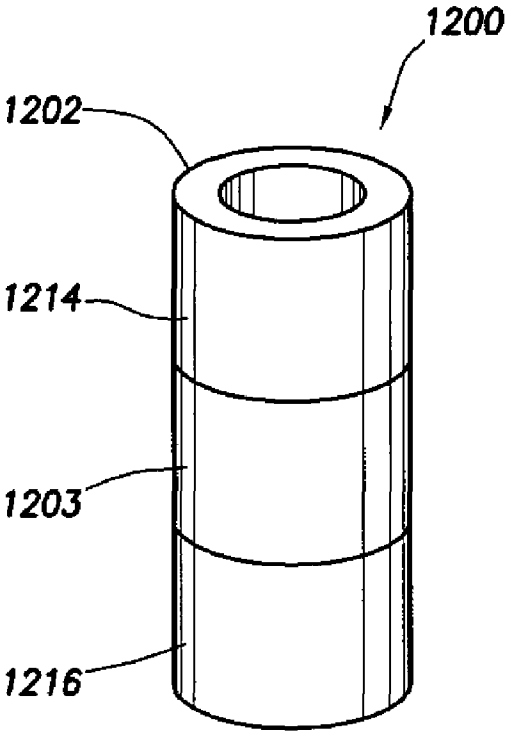
FIG. 12A is a perspective view of an alternate downhole sensor system using a strain gauge system with a central element.

FIGS. 12A and 12B depict another optional configuration of a strain gauge system 1200 including a drill collar 1202, a central element 1208 and a pressure sleeve 1203. In this embodiment, the forces normally applied to the drill collar during the drilling operation are applied to the central element. The central element connects a first portion 1214 and a second portion 1216 of the drill collar. The central element preferably has a smaller cross-section than the drill collar to magnify the deformations experienced when force is applied to the drill collar and/or central element.

The central element 1208 includes an outer sheath 1206, an inner sheath 1204, seals 1212, a jam nut 1219 and strain gauges 1211. The central element 1208 is operatively connected between a first portion 1214 and a second portion 1216 of the drill collar 1202. The connection is preferably non-separable, so that the first portion, central element and second portion form a single component. Another possibility is to manufacture one portion of the drill collar and the central element in one unitary piece and connect the second portion of the drill collar with a lock nut (not shown). While the load sleeve and its components are depicted as separate components, it will be appreciated that such components may be integral.

A passage 1218 is preferably provided within the central element to permit fluid inside the drill collar to flow into the area adjacent the strain gauges. This fluid flow deforms the portion of the central element supporting the strain gauges in such a way that deformation due to hydrostatic pressure is essentially eliminated. The passages may be of any other geometry and the area on which star gauges are positioned may be of any other geometry so that the total deformation of the area due to hydrostatic pressure is substantially zero.

The pressure sleeve is attached to the upper section of the drill collar and is slidably and/or rotatably movable relative to the lower portion of the drill collar. Seals 1220 are positioned between the portions of the drill collar and the pressure sleeve.

The functionality of the drill collar is separated into a load carry function and a pressure and/or mud separating function. The load function is captured by the central element 1208. The pressure and/or mud separating function is captured by the pressure sleeve 1203.

The central element is fixed rigidly between the portions of the drill collar. The central element transfers the axial and torque loads that the drill string receives. The pressure sleeve absorbs internal and external pressure applied to the drill collar and seals both portions of the drill collar. This sleeve preferably does not contribute to the stiffness of the assembly against bending.

The deformations of the drill collar due to hydrostatic pressure are reduced by the passage 1218. The strain gauged area is designed in such a way that tensile strains due to hydrostatic pressure in passage 1218 are superposing on the compressive and circumferential strains caused by the presence of hydrostatic pressure on the outer diameter of the central element and the face surfaces of the central element. For example a dome deformation under the strain gauges can be realized.

The effects of temperature gradients upon the drill collar and the effect of steady state temperature change from a non-strained reference temperature of the drill collar may also be reduced and/or prevented from transferring to the central element. While the central element itself is experiencing deformation due to temperature change, a standard full wheatstone bridge (not shown) may be mounted on the central element to reduce the output of the sensor due to temperature change. The deformation of the central element due to bending about the collar axes are small due to the fact that the radius of the sensing element is small in comparison to the radius of the drill collar.

Figure 12D:
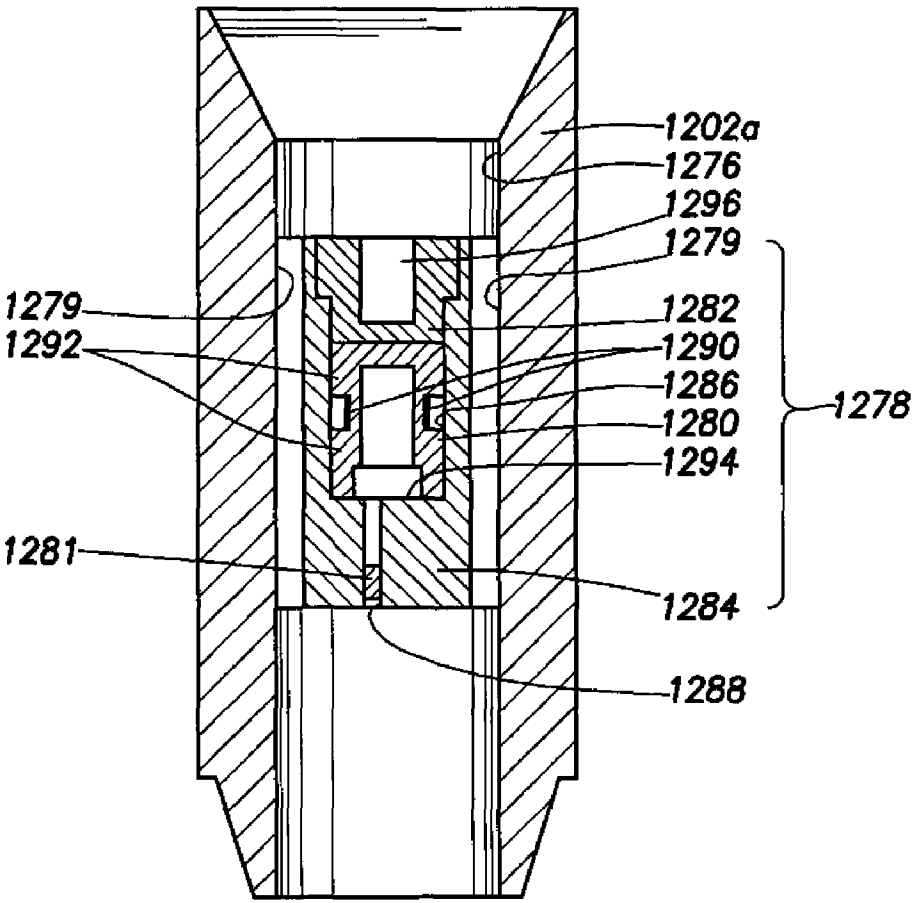
FIG. 12D shows a longitudinal cross section of the downhole sensor system of FIG. 12C.
Figure 12C:
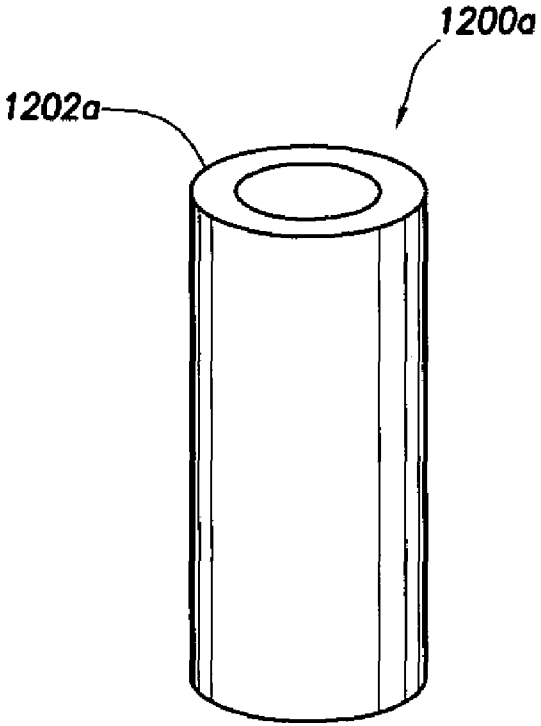
FIG. 12C is a perspective view of an alternate downhole sensor system using a strain gauge system with a load cell.

FIGS. 12C and 12D depict another embodiment of a strain gauge system 1200*a*. The system consists of a drill collar 1202*a* has a passage 1276 therethrough and a load cell system 1278 positioned in the passage. Flow areas 1279 are provided between the load cell system and the drill collar to permit the flow of mud therethrough. The passages and/or flow areas may have a variety of geometries, such as circular or irregular.

The load cell system 1278 includes a load cell housing 1284 supported within the passage 1276, a load cell 1280, piston 1281 and a jam nut 1282. The housing 1284 has a first cavity 1286 therein which houses the load cell, and a second cavity 1288 which houses the piston. The piston moves through the second cavity to transfer hydrostatic pressure from the first cavity with the load cell. The load cell preferably consists of a weaker of strain gauge area 1290, two strong areas 1292 and a cylindrical central cavity 1294.

The jam nut 1282 holds the load cell in place during operations and rigidly connects the load cell to the drill collar in such a way that the axial, circumferential and radial deformations, as well as deformation due to torque on the drill collar, are transferred to the load cell. The jam nut may have a circular cylindrical cavity 1296 to modify the rigidity of the jam nut in the direction of the drill collar axis.

The geometry of the jam nut and load cell are preferably chosen in such a way that the deformation of the drill collar over the entire length of the assembly is concentrated in the weaker area 1290 of the jam nut and thus sensed by the strain gauges. Also, the geometry of the cylindrical cavity 1296 in the load cell is chosen in such a way that the strains experienced by the load cell due to hydrostatic pressure load on the drill collar are equaled and, thus, nullified by the strains that are experienced by the load cell due to pressure load on the cylindrical cavity.

Drilling Jar

Figure 13A:
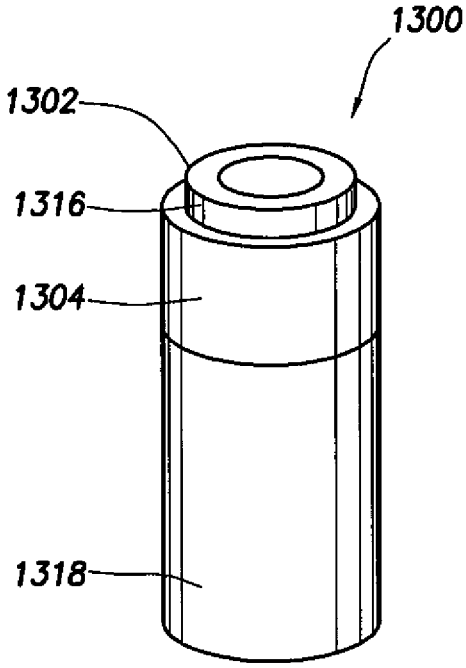
FIG. 13A is a perspective view of an alternate downhole sensor system using a drilling jar system.
Figure 13B:
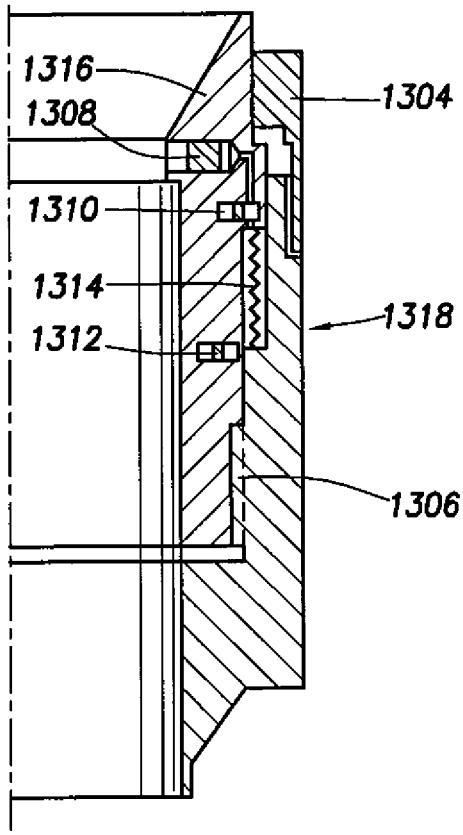
FIG. 13B shows a cross section view of a portion of the downhole sensor system of FIG. 13A.
Figure 13C:
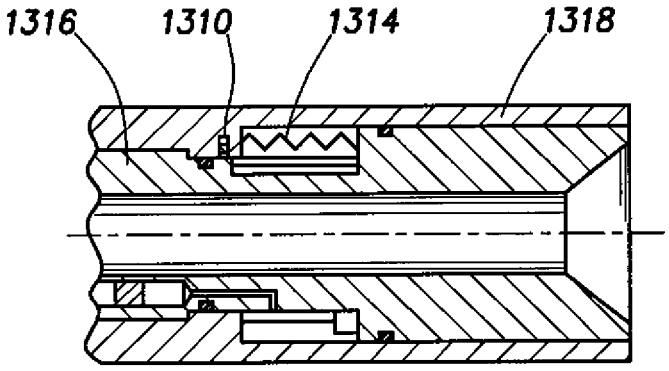
FIG. 13C shows a longitudinal cross section of the downhole sensor system of FIG. 13A.
Figure 14A:
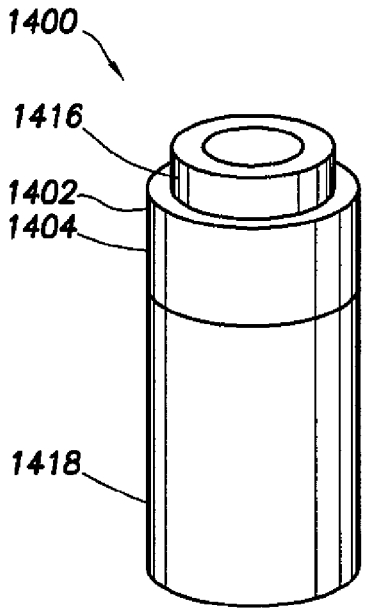
FIG. 14A is a perspective view of an alternate downhole sensor system using a drilling jar system with a fluid chamber.
Figure 14B:
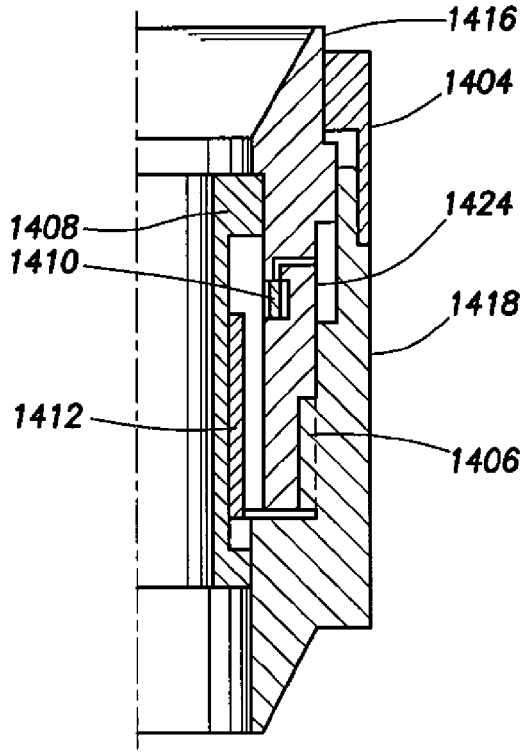
FIG. 14B shows a cross section of a portion of the downhole sensor system of FIG. 14A.
Figure 14C:
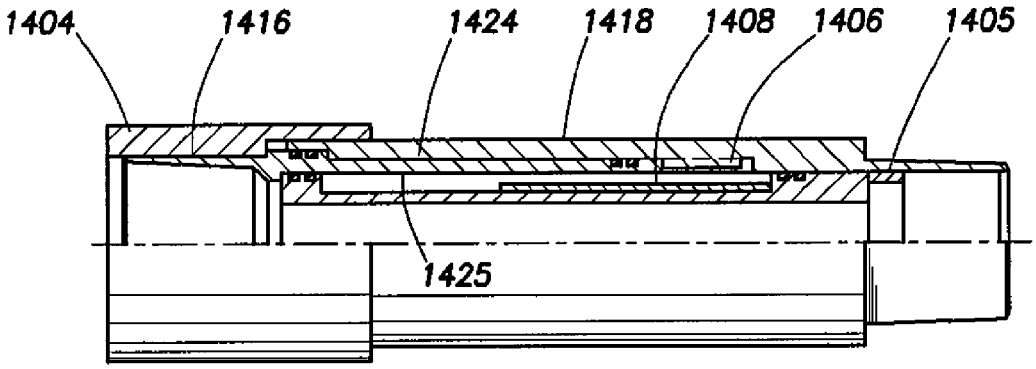
FIG. 14C shows a partial, longitudinal cross section of the downhole sensor system of FIG. 14A.

FIGS. 13-14C depict drilling jar systems usable in a drilling tool. Each of these embodiments incorporates a drilling jar connectable to a drill string, such as the drill string of FIGS. 1 and 2, for measuring downhole forces, such as WOB, TOB and Bend, on a drilling tool. Drilling jars are devices typically used in combination with 'fishing' tools to remove a stuck pipe from a wellbore. An example of such a drilling jar is described in U.S. Pat. No. 5,033,557 assigned to the assignee of the present invention. The drilling jars as used herein incorporate various aspects of drilling jars for use in performing various downhole measurements.

The drilling jar 1300 of FIGS. 13A-13C includes a drill collar 1302 having an upper portion 1316 and a lower portion 1318 slidably connected to each other. The drilling jar also includes a locknut 1304, a torque transmitting key 1306, a piston 1308, displacement sensors 1310, 1312 and a spring 1314. The drilling jar may also be provided with a chassis and seals (not shown).

The movement of the first and second portions of the drill collar is controlled by the spring or elastic element 1314. The locknut 1304 is provided to prevent the drill collar from separating. The displacement sensors 1310, 1312 are mounted into the drill collar to measure the distance traveled between the collar portions. This distance is a function of the WOB force that is applied to the drill collar. The piston 1308 is preferably provided to compensate pressure and to prevent displacement between the drill collar portions due to hydrostatic pressure. The torque transmitting key is also preferably provided to transmit rotation of the respective drill collar portions to the drill bit.

The portions of the drill collar are joined to transmit torque (by way of the key 1306). Between the portions, the elastic element 1314, such as a spring or solid with significantly greater elasticity than steel is introduced. The space in which the elastic element is seated is preferably at hydrostatic pressure. When the drill collar is compressed, the elastic element deforms when the portions are moving towards each other. The distance is measured.

Deformations of the drill collar resulting from factors other than weight, such as to thermal expansion, thermal gradients and thermal transients, are small in comparison to the deformation of the elastic element due to weight. Compensation therefore needs to be less accurate than for solutions where the deformation of the drill collar itself is measured, which is of an order of magnitude smaller for WOB than for other loads.

FIGS. 14A-14C depict an alternate embodiment 1400 of the drilling jar of FIGS. 13A-C. The drilling jar 1400 utilizes a fluid chamber configuration in place of the spring configuration depicted in FIGS. 13A-13C. The drilling jar 1400 includes a drill collar 1402 having an upper portion 1416, middle portion 1404 and a lower portion 1418. The drilling jar 1400 further includes a torque transmitting key 1406, an electronic chassis 1408, a pressure sensor 1410, an electronic circuit board 1412 and a locknut 1405.

The electronic chassis 1408 is disposed about the inner surface of the drill collar adjacent to where the portions meet. The electronic chassis is preferably provided for supporting electronics for measuring pressure from the sensor. The electronics may be used to transmit data collected to the BHA.

The portions of the drill collar are slidably movable relative to each other and secured together via locknut 1405. The portions of the drill collar are joined to form a pressure sealed cylindrical compartment 1424 about the drill collar circumference. The compartment is filled with hydraulic fluid. The pressure of the fluid increases with increasing hydrostatic pressure and axial compression. A mechanical stop (not shown) may be used to secure the compartment from burst pressure. The pressure of the fluid decreases with decreasing hydrostatic pressure and tensile axial loads. Another mechanical stop (not shown) may also be used to prevent the drill collar portions from disassembling in case of overpull.

A pressure sensor may be provided to measure the fluid pressure in the chamber. The pressure in the fluid chamber is a function of the applied WOB force on the drill collar. The pressure and temperature of the fluid is monitored and set in relation to the change of volume of the compartment 1424. This change of volume is a function of the axial force acting on the drill collar. Mud pressure may also be measured and used to compensate the axial deformation measurement. These measurements may be used to further define and analyze the downhole forces.

Figure 15:
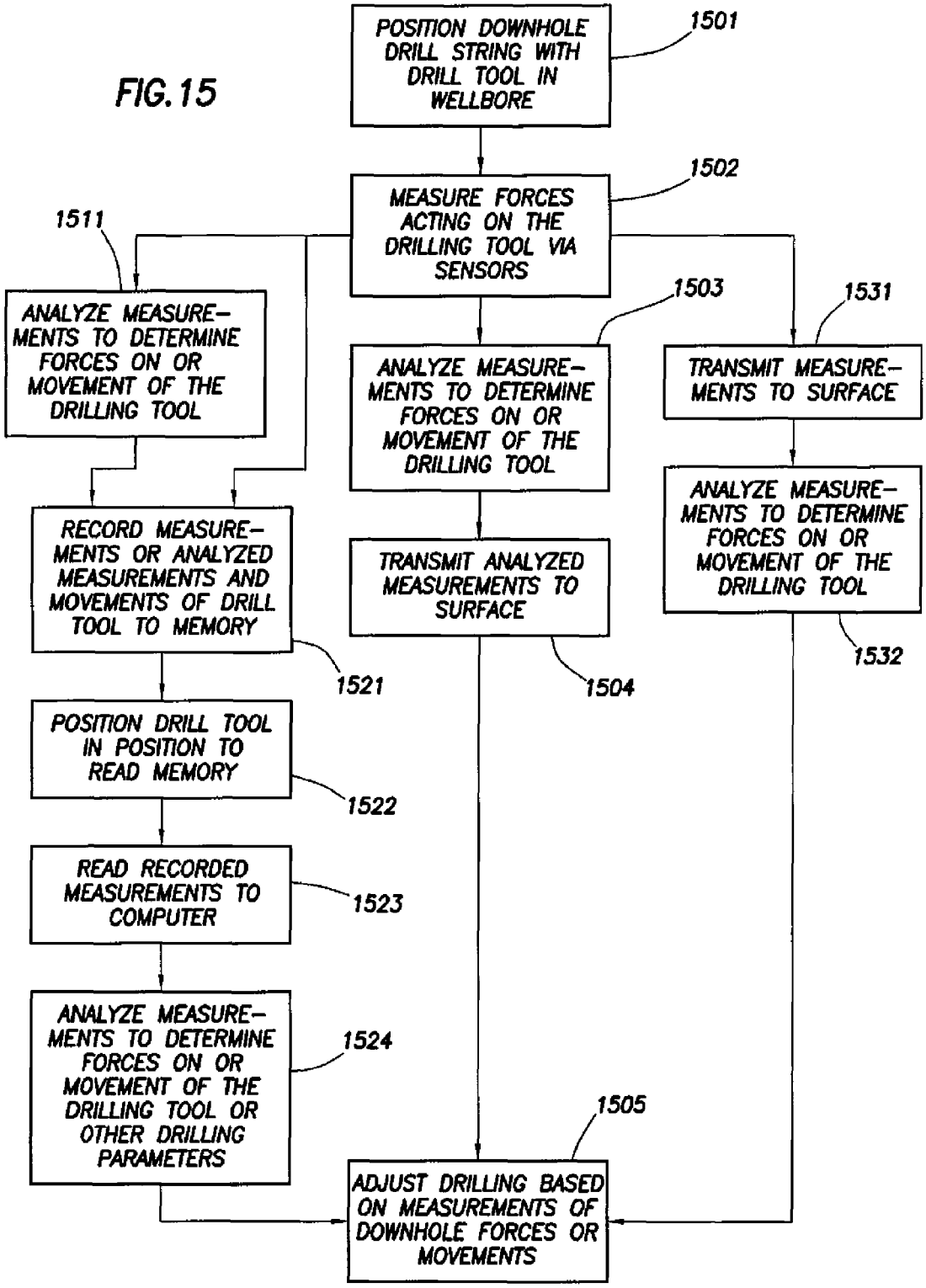
FIG. 15 shows a flow chart depicting a method of taking downhole measurements of forces acting on a drilling tool.

FIG. 15 is a flow chart depicting optional steps that may be used in taking measurements. Downhole forces may be determined once the downhole drill string and drill tool are in the wellbore. The forces acting on the drilling tool are measured via the sensors (such as those in any of the FIGS. 4A-14C). The measurements may be transmitted to the surface using known telemetry systems. The measurements are analyzed to determine the forces. Processors or other devices may be positioned downhole or at the surface to process the measurement data. Drilling decisions may be made based on the data and information generated.

The method includes positioning a drill string with a drilling tool in a wellbore, at step 1501. The method next includes measuring the forces acting on the drilling tool using sensors, at step 1502. This may include measuring an electrical property of the sensor. The data is related to a deformation of the drilling tool, which is related to the load on the drilling tool.

The method may then include several alternative steps. For example, the method may include analyzing the measurements to determine the forces action on the drilling tool or to determine the movement of the drilling too, at step 1511 and 1503. In some cases, determining the forces includes determining the deformation of the drilling tool under the load. Alternately, the load may be determined without specifically determining the deformation of the drilling tool.

Continuing in the alternative steps following 1502, the method may next include transmitting the measurements to the surface, at step 1504. This may be done using any telemetry method known in the art, for example, mud-pulse telemetry. Finally, the method may include adjusting drilling parameters based on the measurements of the downhole forces, loads, and movements, at step 1505.

In another alternative path, the method may include recording the measurements or analyzed measurements in a memory, at step 1521. This may be done using the measurements (from step 1502) or using the analyzed measurements (step 1511).

In another alternative method, the measurements may be transmitted to the surface, at step 1531, where they may be analyzed to determine the forces and loads on the drilling tool, at step 1532. The drilling parameters may then be adjusted based on the measurements of the downhole loads.

The measurements made by the drill tool may include a combination of accelerometers, magnetometers, gyroscopes and/or other sensors. For example, such a combination may include a three axis magnetometer, a three axis accelerometer and angular accelerometer for determining angular position, azimuthal position, inclination, WOB, TOB, annular pressure, internal pressure, mud temperature, collar temperature, transient temperature, temperature gradient of collar, and others. Measurements are preferably made at a high sample rate, for example about 1 kHz.

Figure 16B:
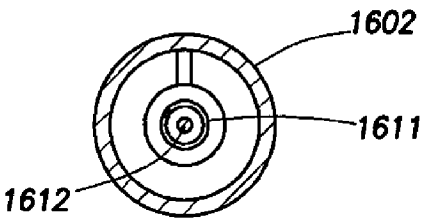
FIG. 16B shows a radial cross section of the downhole sensor system of FIG. 16A.
Figure 16A:
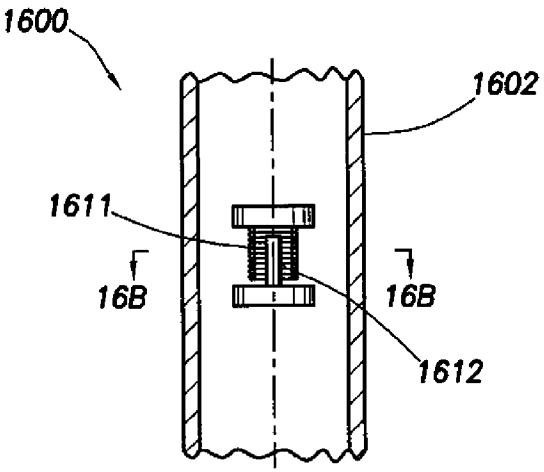
FIG. 16A shows a longitudinal cross section of an alternate downhole sensor system using LVDT.

FIG. 16A shows another system 1600 in accordance with the invention that uses an LVDT to determine the compressive deformation. The system 1600 is disposed in a drill collar 1602, and it includes an annular "coil" 1611 and a cylindrical "core" 1612. The core 1612 is able to move within the coil 1611. FIG. 16B is a radial cross section of the sensor 1600 taken along line 16B-16B in FIG. 16A. The core 1612 is located within the coil 1611, and the entire sensor 1600 is located along the axis of the drill collar.

The coil 1611 is a hollow cylinder that includes a primary winding in the center and two secondary windings near the ends of the cylinder (windings are well known in the art, and they are not shown in the figures). The core 1612 may be constructed of a magnetically permeable material and sized so that it can move axially within the coil 1611, without contact between the two. The primary winding is energized with AC current, and the output signal, a differential voltage between the two secondary windings, is related to the position of the core 1612 within the coil 1611. By coupling the coil 1611 and the core 1612 at different axial points in the drill collar 1602, the core 1612 and the coil 1611 will move relative to each other when the drill collar 1602 experiences deformation from a load, such as WOB. The magnitude of the movement is related to the magnitude of the WOB, which can then be determined.

The system in FIGS. 16A and 16B uses a similar principle of induction to determine the deformation. That is, with a constant current AC power source, the changes in measured differential voltage indicate a change in the inductance of the sensor. The relationship between impedance and inductance is shown in Equation 4:

$$Z=2\pi d \qquad \text{Equation 4}$$

where L is the inductance of the sensor. Because the change in inductance is caused by the movement of the core 1612 within the coil 1612, the change in impedance is related to the magnitude of the deformation and the WOB.

Figure 17:
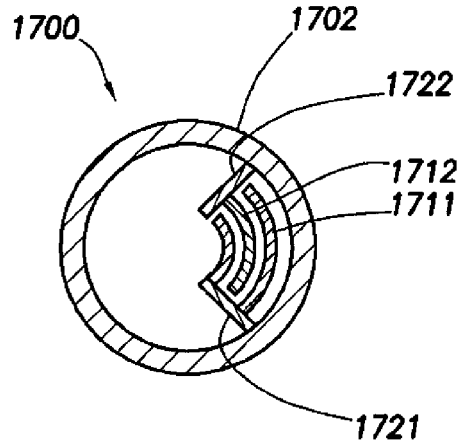
FIG. 17 shows a radial cross section of an alternate downhole sensor system using LVDT with a coil and a core.

FIG. 17 shows an alternate LVDT drilling sensor system 1700. The system 1700 is similar to the system 500 of FIGS. 16A-B, except that the coil 1711 and the core 1712 are arched or curved so that they can move with respect to each other when the drill collar 1702 experiences TOB. In some embodiments, the coil 1711 and the core 1712 are coupled to the drill collar 1702 at different axial positions so that the deformation of the drill collar 1702 due to TOB will create relative movement between the coil 1711 and the core 1712. For example, support 1721 may be coupled to the drill collar 1702 at a different axial position than the support 1722.

Figure 18A:
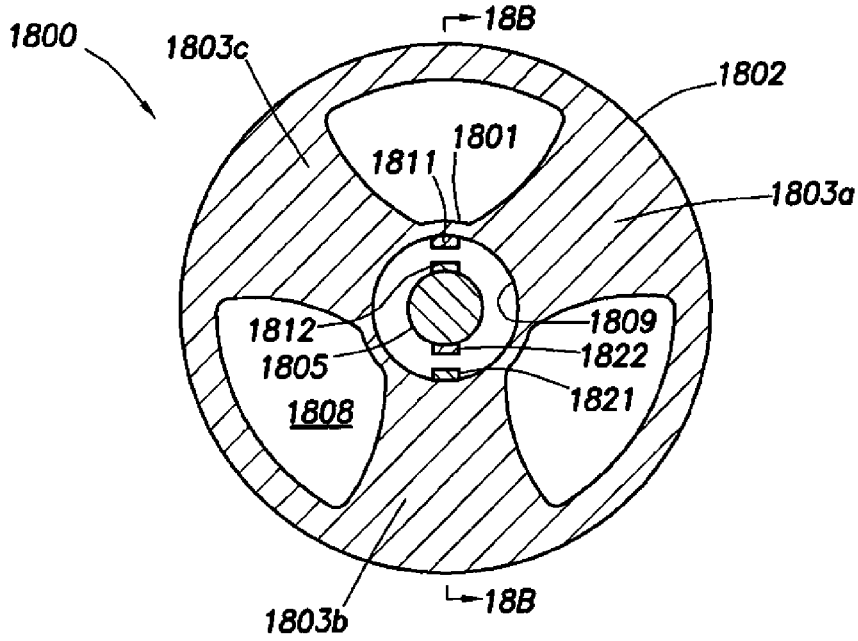
FIG. 18A shows a radial cross section of an alternate downhole sensor system positioned in a hub of a drill collar.

FIG. 18A shows a radial cross section of a sensor system 1800. The sensor system 1800 is located in a central hub 1801 of drill collar 1802, along the axis of the drill collar 1802. The sensor system 1800 includes four capacitor plates 1811, 1812, 1821, 1822. A first capacitor plate 1811 and a third capacitor plate 1821 are disposed on an inside wall 1809, spaced 180 degrees apart. A column 1805 is located in the center of the drill collar 1802. A second capacitor plate 1812 and a fourth capacitor plate 1822 are fixed on the column 1805 so that they are 180 degrees apart and oppose the first capacitor plate 1811 and the third capacitor plate 1821, respectively. Three petals 1803*a*, 1803*b*, 1803*c* of the drill collar 1802 extend inwardly, while still enabling mud flow through the passages 1808.

Figure 18B:
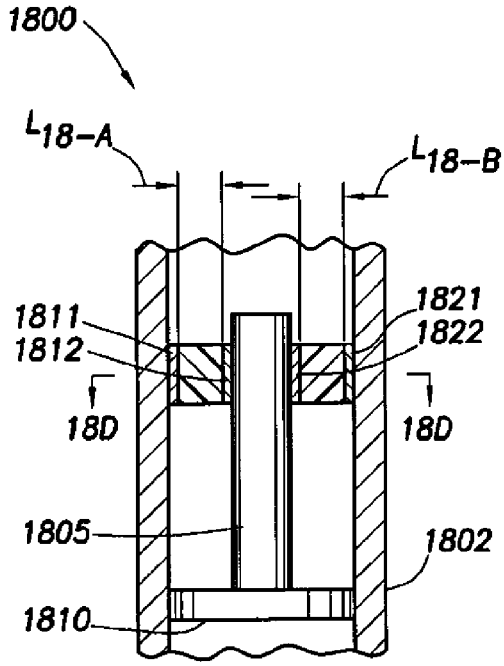
FIG. 18B shows a longitudinal cross section of the downhole sensor system of FIG. 18A.

FIG. 18B shows a longitudinal cross section of the sensor system 1800 through line 18B-18B in FIG. 18A. The first plate 1811 and the second plate 1812 are spaced by a distance $L_{18\text{-}A}$. The third plate 1821 and the fourth plate 1822 are separated by a distance $L_{18\text{-}B}$. In some embodiments, the distances $L_{18\text{-}A}$, $L_{18\text{-}B}$ are about the same in a relaxed or no-bend state, although the distances $L_{18\text{-}A}$, $L_{18\text{-}B}$ need not be the same in the relaxed state.

Figure 18C:
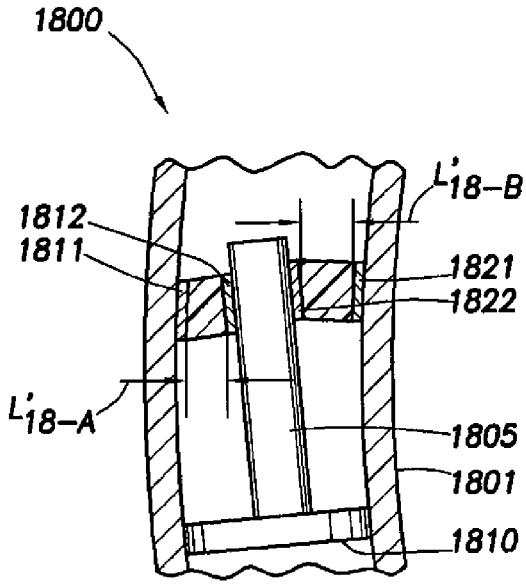
FIG. 18C shows the downhole sensor system of FIG. 18B with a force applied thereto.

FIG. 18C shows a cross section of the sensor system 1800 (and the drill collar—1802 in FIG. 18A) as it experiences Bend. The column 1805 is configured so that it will not bend, even though the drill collar is experiencing bend. Because of this configuration, the distance $L'_{18\text{-}A}$ between the first plate 1811 and the second plate 1812 is shorter that the distance $L_{18\text{-}A}$ in the relaxed state (shown in FIG. 18B). The shorter distance $L'_{18\text{-}A}$ reduces the capacitance between the first plate 1811 and the second plate 1812, in accordance with Equation 1.

In the bend state shown in FIG. 18C, the distance $L'_{18\text{-}B}$ between the third plate 1821 and the fourth plate 1822 is greater than the distance $L'_{18\text{-}B}$ between the third plate 1821 and the fourth plate 1822 in a relaxed state (shown in FIG. 18B). This increase in distance will decrease the capacitance between the third plate 1821 and the fourth plate 1822, in accordance with Equation 1.

Using the sensor shown in FIGS. 18A-18C, the bend of the drill collar 1802 may be determined from the change in the capacitance of capacitor plate pairs. A change in the capacitance between the first plate 1811 and the second plate 1812 will indicate a bend in the drill collar 1802. Also, a change in the capacitance in between the third plate 1821 and the fourth plate 1822 will indicate a bend in the drill collar 1802. The change in capacitance is related to the deformation of the bend. The two pairs of capacitor plates (i.e., 1811-1812, 1821-1822) are redundant for measuring Bend. A system could be devised that includes just one pair of plates.

Figure 18D:
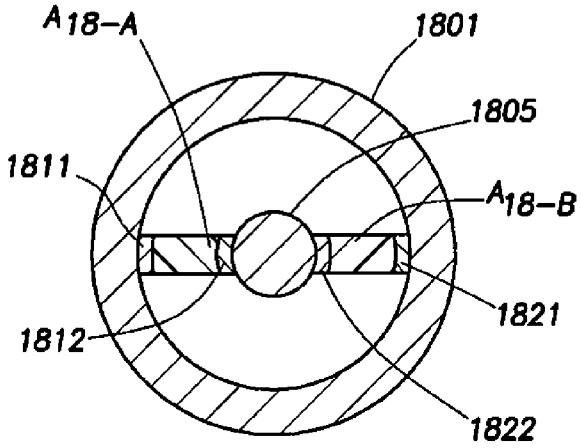
FIG. 18D shows the downhole sensor system of FIG. 18A having capacitor plates in an aligned position.

The sensor shown in FIGS. 18A-18C also enables the determination of the TOB. FIG. 18D shows a cross section of the sensor system of FIG. 18B taken along line 18D-18D, where the first plate 1811 and the third plate 1821 are coupled to the inner surface 1809 at one axial point. The second plate 1812 and the fourth plate 1822 are coupled to the column 1806, which is coupled to the drill collar 1802 at a different axial point than the first plate 1811 and the third plate 1821. When the drill collar (1802 in FIG. 18A) is subjected to a TOB, the resulting deformation and the different axial positions where the plates are coupled to the drill collar 1802 will cause the first plate 1811 and the third plate 1821 to move with respect the second plate 1821 and the fourth plate 1822.

Figure 18E:
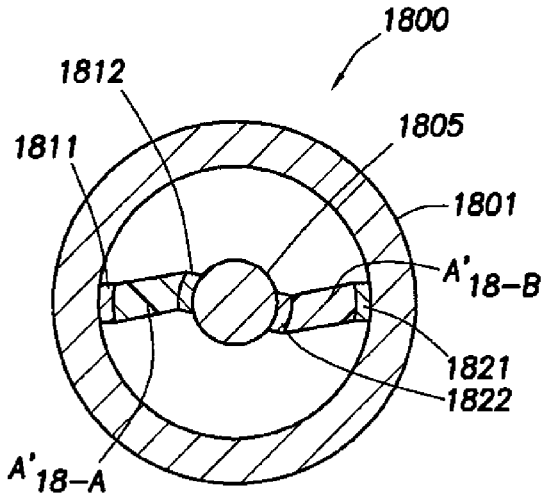
FIG. 18E shows the downhole sensor system of FIG. 18D with a force applied thereto.

In the relaxed state, or un-tourqued state, shown in FIG. 18D, the first plate 1811 and the second plate 1812 have an capacitive area of $A_{18\text{-}A}$, and the third plate 1821 and the fourth plate 1822 have a capacitive area of $A_{18\text{-}B}$. FIG. 18E shows a cross section of the sensor system 1800 of FIG. 18D with a torque applied to the drill collar 1802, such as TOB for example. The first capacitor plate 1811 has rotated with respect to the second capacitor plate 1812. The relative movement causes the capacitive area to be reduced from $A_{18\text{-}A}$ (in FIG. 18E) to $A'_{18\text{-}A}$ Similarly, the applied torque causes the third capacitor plate 1821 to move with respect to the fourth capacitor plate 1822. The relative movement causes the capacitive area to be reduced from $A_{18\text{-}B}$ (in FIG. 18E) to $A'_{18\text{-}B}$.

Equation 1 shows that a reduction in the capacitive area between two capacitor plates will cause a reduction in the capacitance between the plates. Thus, when a torque is applied to the drill collar, the resulting deformation can be determined from the change in the capacitance between two capacitor plates (e.g., the first plate 1811 and the second plate 1812).

The particular configuration shown in FIGS. 18A-18E enables the determination of both the TOB and the bend of the drill collar. The bend in the drill collar causes an increase in the capacitance of one of the capacitor plate pairs and a decrease in the capacitance in the other pair of capacitor plates. The TOB causes a decrease in the capacitance of both capacitor plate pairs. Because of this difference, any changes in the capacitance of the capacitor plate pairs can be resolved into a TOB and a bend in the drill collar.

FIGS. 18A-18E show a sensor where there are two pairs of capacitor plates. Other embodiments could be devised that use only one pair or more than two pairs of capacitor plates without departing from the scope of the invention. One particular embodiment, having only one capacitor plate pair, the sensor may not be able to resolve both the TOB and the bend. Nonetheless, such embodiments do not depart from the scope of the invention. Also, the invention is not limited to capacitor plates that are spaced 180 degrees apart. That particular spacing was shown only as an example. The first capacitor plate 1011 and the second capacitor plate 1021 are shown with the maximum capacitive area in the relaxed state (FIG. 10D). Other embodiments with different arrangements of the capacitor plated may be devised without departing from the scope of the invention.

Figure 19:
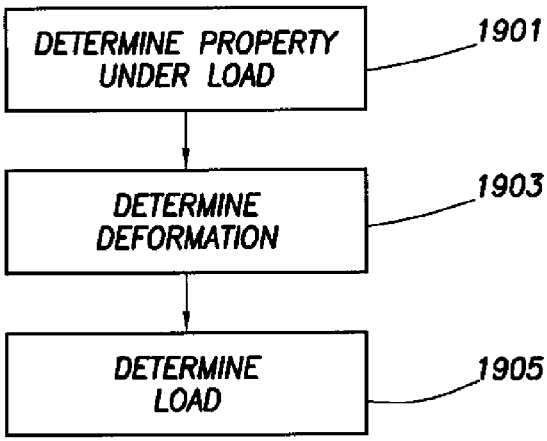
FIG. 19 shows a flow chart depicting a method of determining an electrical property of a sensor.

FIG. 19 shows a method in accordance with one or more embodiments of the invention. The method includes determining an electrical property of a sensor when the drill string is in a loaded condition (shown at step 1901). The method also includes determining the magnitude of the load on the drill string based on the difference between the electrical property of the sensor when the drill string is in the loaded condition and the electrical property of the sensor when the drill string is in a relaxed state (shown at step 1905).

The load may be determined because the difference in the electrical property of the sensor between the relaxed condition and the loaded condition in related to the drill collar deformation. The deformation is, in turn, related to the load.

In some embodiments, the method includes determining the magnitude of the deformation of the drill collar (shown at step 1903). This may be advantageous because it enables the determination of the stress and strain on the drill collar.

A drill collar or a BHA may include any number of sensor embodiments in accordance with the invention. The use of multiple embodiments of sensors may enable the simultaneous determination of WOB, TOB, and bend, as well as other forces that act on a drill string during drilling. For example, a drill collar may include an embodiment of a sensor that is similar to the embodiment shown in FIG. 4A, as well as an embodiment of a sensor similar to the embodiment shown in FIG. 18A.

The variations in temperature and pressure can have significant effects on the deformation of the drill string. For example, the temperature in the borehole can vary between 50° C. and 200° C., and the hydrostatic pressure, which increases with depth, can be as high at 30,000 psi in deep wells. The thermal expansion and compression due to the hydrostatic pressure can cause deformations that are several orders of magnitude higher than the deformations caused by WOB. Thus, for example, the distance between the capacitor plates 404 in FIG. 4 is the sum of the effects of WOB, thermal expansion, and pressure compression. Compensating for the thermal expansion and pressure effects will enable more accurate measurements of downhole forces.

Figure 20:
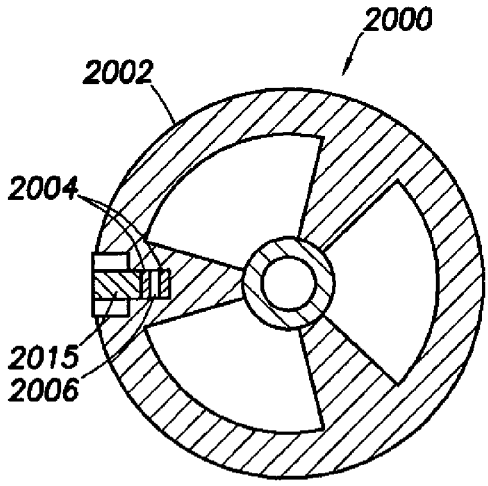
FIG. 20 shows a radial cross section of an alternate downhole sensor for determining the effects of thermal expansion and pressure.

FIG. 20 shows a sensor system 2000 for determining the effects of thermal expansion and pressure. Two capacitor plates 2004 are disposed in a drill collar 2002. The capacitor plates 2004 are oriented vertically and spaced apart in the radial direction. A support 2015 is positioned behind the outermost plate 2004, and a dielectric material 2006 is positioned between the plates 2004. When the hydrostatic pressure increases, the support 2015, as well as the remainder of the drill collar 2002, causes the plates 2004 to move closer together. This deformation will cause a corresponding increase in the capacitance of the system 2000.

The system 2000 will also be responsive to temperature changes that cause thermal expansion in the drill collar 2002. Because the system 2000 is disposed inside the drill collar 2002, it will expand and contract with the drill collar 2002 in response to temperature and pressure changes.

Because of the vertical orientation of the plates 2004, and because they are coupled to the drill collar at substantially the same axial location, the system 2000 will be relatively insensitive to deformations that result from WOB, TOB, and bending moments. The system 2000 will mostly be responsive to thermal expansion and pressure effects. This will enable a more accurate determination of downhole forces by using the data relating to thermal expansion and pressure effects when determining WOB, TOB, and/or bending moments based on other sensors in the drill collar 2002.

Figure 21:
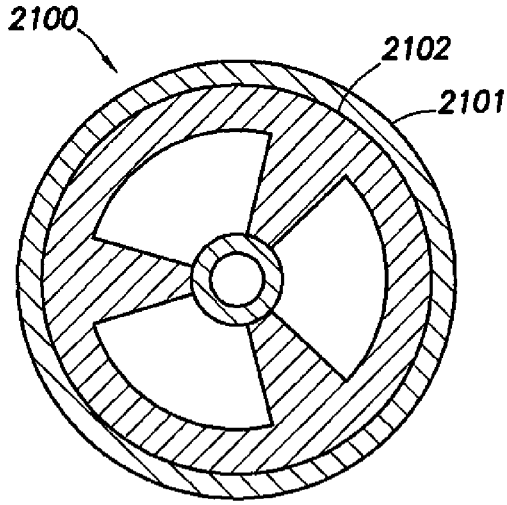
FIG. 21 shows a radial cross section of drill collar of a downhole tool having a thermal coating.

FIG. 21 shows a drill collar 2102 with a thermal coating 2101. This drill collar may be used in combination with the various sensor systems described herein. Because the drill collar 2102 is metal, is will conduct heat very well. If there are significant temperature gradients between the internal structures of the drill collar and the surrounding borehole, the thermally conductive drill collar 2102 will transmit the thermal energy. This will facilitate the effects of thermal expansion.

A thermal coating 2101 will insulate the drill collar 2102 from temperature gradients. The temperature drop will be experiences across the insulating material, and not across the drill collar 2102 itself. There are many materials that are known in the art that may be suitable. For example some types of rubber and elastomers will insulate the drill collar 2102 and withstand the tough downhole environment. Other materials such as fiberglass may be used.

Figure 22:
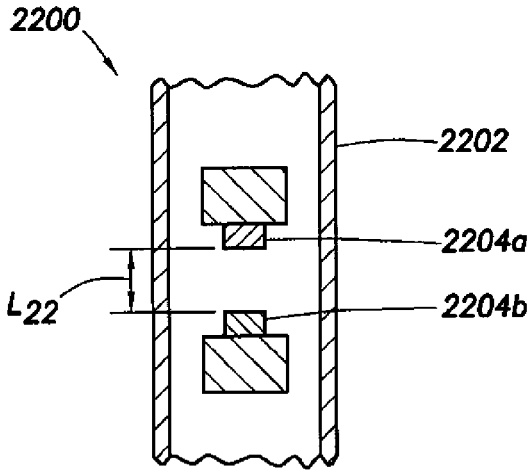
FIG. 22 shows a longitudinal cross section of an alternate downhole sensor system using a non-capacitance sensor.

FIG. 22 shows another sensor system 2200 in accordance with the invention. A drill collar 2202 includes a first sensing element 2204*a* and a second sensing element 2204*b*. The configuration in FIG. 22 is similar to the configuration in FIG. 4, except that the sensor system in FIG. 22 does not use a capacitor to determine the deformation (i.e., the change in $L_{22}$ under load). Instead, the sensor in FIG. 22 may use an eddy current sensor, an infrared sensor, or an ultrasonic sensor.

Referring again to FIG. 22, the sensor system 2200 may include an eddy current sensor, with a coil in sensing element 2204*a* and a target in sensing element 2204*b*. Such an sensor 2200 does not require a dielectric material between the sensing elements 2204*a, b* so long as there are no metallic materials. The drive electronics and signal processing block are not shown in FIG. 22, but those having ordinary skill in the art will appreciate that those elements of an eddy current sensor may be included in any manner known in the art.

Instead of an eddy current sensor system, the sensor system 2200 in FIG. 22 may include an ultrasonic sensor or an infrared sensor. For example, an ultrasonic sensor may include an ultrasonic source at 2204*a* and an ultrasonic receiver at element 2204*b*. An infrared sensor may include an infrared source at 2204*a* and an infrared detector at element 2204*b*.

Embodiments of the present invention may present one or more of the following advantages. Capacitive and inductive systems in accordance with the invention are not susceptible to measurement errors based on changes in temperature. Ambient pressure also does not affect the operations of certain embodiments of these systems. Additionally, these systems do not have contacting parts that could wear out or need to be replaced.

Advantageously, certain embodiments of the present invention enable the measurement of WOB without any sensitivity to torque or bend. Moreover, one or more embodiments of the invention enable the determination of two or more loads on a drill bit or drill string.

Advantageously, certain embodiments of the present invention provide a useable signal that will yield accurate and precise results without the use of a mechanical amplification of the deformation. A system in accordance with the invention may be installed directly into a drill collar without the need for a separate load cell. Thus, certain embodiments may occupy minimal space in a drill collar.

Advantageously, certain embodiments of the present invention are mounted internal to a drill collar. Such embodiments are not susceptible to borehole interference or other problems related to the flow of mud.

Advantageously, certain embodiments of the present invention are less affected by temperature variations than prior art sensors. In addition, some embodiments my enable compensation for strain caused by pressure and temperature variations downhole.

While the invention has been described with respect to a limited number of embodiments, those skilled in the art, having benefit of this disclosure, will appreciate that other embodiments can be devised that do not depart from the scope of the invention as disclosed herein. Accordingly, the scope of the invention should be limited only by the attached claims.

What is claimed is:

1. An apparatus for measuring a load on a downhole drilling tool suspended in a wellbore via a drill string, comprising:

a drill collar operatively connectable to the drill string, the drill collar adapted to magnify deformation resulting from forces received thereto;

two capacitative plates mounted to the drill collar at distinct axial positions along the drill collar, the capacitative plates separated by a dielectric, the plates adapted to move with respect to each other to measure the deformation of the drill collar whereby forces on the downhole drilling tool are determined.

2. The apparatus of claim 1 wherein the sensor comprises one of capacitance, linear variable differential transformer, impedance, differential variable reluctance, eddy current, inductive sensor and combinations thereof.

3. The apparatus of claim 1 further comprising at least one sleeve about the drill collar.

4. The apparatus of claim 3 wherein the drill collar has a partial cut therethrough whereby the drill collar acts as a spring.

5. The apparatus of claim 3 wherein the at least one sleeve connects portions of the drill collar.

6. The apparatus of claim 1 wherein the drill collar has first and second portions and an elastic element therebetween.

7. The apparatus of claim 1 wherein the drill collar has first and second portions and a sleeve, the sleeve connecting the portions and defining a cavity therebetween, the sensor adapted to measure pressure changes in the cavity.

8. A downhole sensor for measuring a load on a downhole drilling tool suspended in a wellbore via a drill string, comprising:

a first capacitor plate positioned in the downhole tool; and a second capacitor plate positioned in the downhole tool, wherein the first capacitor plate and the second capacitor plate are coupled to the downhole tool such that one selected from a relative position of the first and second capacitor plates and an area or a distance between the capacitor plates is changed when the drilling tool is subject to the load.

9. The downhole sensor of claim 8, further comprising:

a dielectric material disposed between the first capacitor plate and the second capacitor plate.

10. The downhole sensor of claim 9, wherein the first capacitor plate is substantially parallel to the second capacitor plate.

11. The downhole sensor of claim 9, wherein the first capacitor plate and the second capacitor plate are positioned substantially perpendicular to the direction of the load to be measured.

12. The downhole sensor of claim 9, wherein the first capacitor plate and the second capacitor plate are positioned substantially perpendicular to an axis of the downhole tool.

13. The downhole sensor of claim 9, wherein the first capacitor plate and the second capacitor plate are positioned substantially parallel to an axis of the downhole tool.

14. The downhole sensor of claim 9, wherein the first capacitor plate and the second capacitor plate are disposed in the center of the downhole tool.

15. The downhole sensor of claim 9, wherein the first capacitor plate and the second capacitor plate are disposed away from the center of the downhole tool.

16. The downhole sensor of claim 15, wherein the first and second capacitor plates comprise a first capacitor set, the first capacitor set disposed in a first leaf of the downhole tool, and further comprising:

a second capacitor set disposed in a second leaf of the drill collar; and a third capacitor set disposed in a third leaf of the drill collar.

17. The downhole sensor of claim 15, wherein the first capacitor plate is positioned along a first radius of the downhole tool and the second capacitor plate is disposed along a second radius of the downhole tool.

18. The downhole sensor of claim 17, wherein the first capacitor plate is coupled to the downhole tool at a first radial position, and the second capacitor plate is coupled to the downhole tool at a second radial position.

19. The downhole sensor of claim 9, further comprising:

a post disposed in the center of the downhole tool and coupled to the downhole tool at a first axial position, a third capacitor plate coupled to the downhole tool about 180 degrees away from the first capacitor plate; and a fourth capacitor plate coupled to the post proximate the third capacitor plate, wherein the second capacitor plate is coupled to the post about 180 degrees away from the fourth capacitor plate and proximate the first capacitor plate, wherein the first capacitor plate, the second capacitor plate, the third capacitor plate, and the fourth capacitor plate are positioned such that the first and second capacitor plates form a first capacitor and the third and fourth capacitor plates form a second capacitor.

20. The downhole sensor of claim 8, further comprising a thermal coating disposed around the downhole tool.

21. The downhole sensor of claim 20, wherein the thermal coating comprises an elastomer.

22. The downhole sensor of claim 20, wherein the thermal coating comprises fiberglass.

23. The downhole sensor of claim 8, further comprising a temperature and pressure compensator, comprising:

a first compensator capacitor plate disposed in the drill collar;

a second compensator capacitor plate disposed proximate the first compensator capacitor plate in the drill collar;

a second dielectric material disposed between the first and second compensator capacitor plates, wherein the first and second compensator capacitor plates are positioned away from the center of the drill collar, parallel to the axis of the drill collar, and coupled to the drill collar at the substantially same axial position.

* * * * *